US009775408B2

(12) United States Patent
Cross

(10) Patent No.: US 9,775,408 B2
(45) **Date of Patent: *Oct. 3, 2017**

(54) FOOTWEAR WITH AUXETIC GROUND ENGAGING MEMBERS

(71) Applicant: NIKE, Inc., Beaverton, OR (US)

(72) Inventor: Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/565,143

(22) Filed: Dec. 9, 2014

(65) Prior Publication Data

US 2016/0157558 A1 Jun. 9, 2016

(51) Int. Cl.
*A43B 13/22* (2006.01)
*A43B 5/00* (2006.01)
(Continued)

(52) U.S. Cl.
CPC ..... *A43B 13/223* (2013.01); *A43B 5/00* (2013.01); *A43B 13/14* (2013.01); *A43B 13/181* (2013.01); *A43B 13/184* (2013.01); *A43B 13/187* (2013.01)

(58) Field of Classification Search
CPC ..... A43B 13/14; A43B 13/141; A43B 13/18; A43B 13/181; A43B 13/184; A43B 13/187; A43B 13/122; A43B 13/42; A43B 13/223; A43B 1/0009; A43B 13/22; A43B 13/142
USPC ..... 36/103, 31, 30 R, 3 B, 25 R, 28, 134, 36/59 C, 102; D2/960, 959, 958, 951, D2/957
See application file for complete search history.

(56) References Cited

U.S. PATENT DOCUMENTS 503,062 A 8/1893 Norwood
2,580,840 A 1/1952 Rikard
(Continued)

FOREIGN PATENT DOCUMENTS

EP 0207063 12/1986
GB 2455167 A 6/2009
(Continued)

OTHER PUBLICATIONS

International Search Report and Written Opinion dated Apr. 1, 2016 in PCT Application No. PCT/2015/055635.
(Continued)

*Primary Examiner* — Khoa Huynh
*Assistant Examiner* — Griffin Hall
(74) *Attorney, Agent, or Firm* — Quinn IP Law

(57) ABSTRACT

An article of footwear may include an outer member comprising a first ground engaging member extending substantially downward from the outer surface of an outer member. Ground engaging members may be auxetic structures that can increase their dimensions in a direction that is orthogonal to the direction of applied force or tension. The outer member may have a substantially uniform thickness. Ground engaging member shapes may include various polygonal features. The first ground engaging member may have a substantially three-pointed star-shaped pyramidal structure. The first ground engaging member may have three arm portions, a central region, a central tip, and an apex. The outer member may have an inner surface with apertures that correspond with the ground engaging members of the outer surface.

14 Claims, 15 Drawing Sheets

(51) Int. Cl.
*A43B 13/14* (2006.01)
*A43B 13/18* (2006.01)

(56) References Cited

U.S. PATENT DOCUMENTS 2,627,676 A 2/1953 Hack
2,963,722 A 12/1960 Stix
3,018,571 A * 1/1962 Doherty ..... A43B 13/18 36/59 C
3,626,532 A 12/1971 Frank
3,745,600 A 7/1973 Rubico et al.
3,757,436 A 9/1973 Winkler et al.
4,071,963 A * 2/1978 Fukuoka ..... A43B 7/06 36/3 B
4,340,626 A 7/1982 Rudy
4,375,728 A * 3/1983 Dassler ..... A43B 13/223 36/114
4,535,553 A * 8/1985 Derderian ..... A43B 13/181 36/28
4,668,557 A 5/1987 Lakes
4,753,021 A * 6/1988 Cohen ..... A43B 13/206 36/25 R
4,756,098 A 7/1988 Boggia
4,999,931 A 3/1991 Vermeulen
5,197,206 A * 3/1993 Shorten ..... A43B 1/0009 36/28
5,337,492 A * 8/1994 Anderie ..... A43B 13/183 36/114
5,713,140 A * 2/1998 Baggenstoss ..... A43B 13/206 36/25 R
5,918,338 A 7/1999 Wong
6,151,804 A 11/2000 Hieblinger
6,266,897 B1 * 7/2001 Seydel ..... A43B 13/16 36/25 R
6,276,073 B1 8/2001 Curley, Jr.
6,412,593 B1 7/2002 Jones
6,826,852 B2 * 12/2004 Fusco ..... A43B 13/12 36/103
6,862,820 B2 3/2005 Farys et al.
6,959,505 B2 * 11/2005 Poe ..... A43B 1/0009 36/141
7,132,032 B2 11/2006 Tawney et al.
7,146,752 B2 * 12/2006 Pasternak ..... A43B 13/223 36/59 C
7,160,621 B2 1/2007 Chaudhari et al.
D541,017 S * 4/2007 McClaskie ..... D2/951
7,254,906 B2 8/2007 Morris et al.
7,287,343 B2 10/2007 Healy
7,546,698 B2 6/2009 Meschter
7,574,818 B2 8/2009 Meschter
7,596,889 B2 10/2009 Pasternak et al.
D612,610 S 3/2010 Gonzalez
7,770,307 B2 8/2010 Meschter
7,814,852 B2 10/2010 Meschter et al.
7,870,681 B2 1/2011 Meschter
7,870,682 B2 1/2011 Meschter et al.
D643,196 S 8/2011 Young
8,002,879 B2 8/2011 Hook
8,074,418 B2 * 12/2011 Thiagarajan ..... E04C 2/543 403/290
8,084,117 B2 * 12/2011 Lalvani ..... B32B 3/266 428/135
8,122,616 B2 2/2012 Meschter et al.
8,132,340 B2 3/2012 Meschter
8,225,530 B2 7/2012 Sokolowski et al.
8,266,827 B2 9/2012 Dojan et al.
8,277,719 B2 10/2012 Alderson et al.
8,312,645 B2 11/2012 Dojan et al.
8,375,604 B2 2/2013 Eder et al.
8,388,791 B2 3/2013 Dojan et al.
8,490,299 B2 7/2013 Dua et al.
8,544,197 B2 10/2013 Spanks et al.
8,590,179 B2 * 11/2013 Sink ..... A43B 13/145 36/103
8,631,589 B2 1/2014 Dojan
8,652,602 B1 * 2/2014 Dolla ..... B29C 44/357 428/36.1
8,763,277 B2 * 7/2014 Sartor ..... A43B 7/1415 36/25 R
D716,027 S * 10/2014 Kirschner ..... D2/951
2004/0111922 A1 6/2004 Fusco
2004/0181972 A1 9/2004 Csorba
2005/0252037 A1 * 11/2005 Hofmann ..... A43B 1/0009 36/28
2005/0252038 A1 * 11/2005 Braunschweiler ..... A43B 3/24 36/28
2006/0265905 A1 * 11/2006 Chandler ..... A43B 13/14 36/25 R
2008/0011021 A1 1/2008 Starbuck et al.
2008/0209766 A1 * 9/2008 Braunschweiler ... A43B 13/184 36/102
2009/0064536 A1 3/2009 Klassen et al.
2009/0064540 A1 * 3/2009 Sokolowski ..... A43B 3/126 36/114
2009/0119820 A1 5/2009 Bentham et al.
2009/0241369 A1 10/2009 Votolato
2009/0241371 A1 * 10/2009 Kimura ..... A43B 13/181 36/28
2009/0307932 A1 12/2009 Kirby et al.
2010/0095551 A1 4/2010 Gupta et al.
2011/0119956 A1 5/2011 Borel et al.
2011/0168313 A1 7/2011 Ma et al.
2011/0247237 A1 * 10/2011 Jara ..... A43B 3/0036 36/103
2012/0021167 A1 1/2012 Plant
2012/0023686 A1 2/2012 Huffa et al.
2012/0129416 A1 5/2012 Anand et al.
2012/0159810 A1 6/2012 Klassen
2012/0180341 A1 * 7/2012 Crowley, II ..... A43B 1/0009 36/103
2012/0181896 A1 7/2012 Kornbluh et al.
2012/0233878 A1 9/2012 Hazenberg et al.
2012/0315456 A1 12/2012 Scarpa et al.
2013/0071583 A1 3/2013 Evans et al.
2013/0081305 A1 4/2013 Byrne
2013/0160324 A1 6/2013 Peyton et al.
2013/0328440 A1 12/2013 Kornbluh et al.
2014/0026438 A1 * 1/2014 Cortez ..... A43B 13/181 36/28
2014/0053311 A1 2/2014 Nordstrom et al.
2014/0059734 A1 * 3/2014 Toronjo ..... A41D 31/005 2/69
2014/0101816 A1 4/2014 Toronjo
2014/0109286 A1 * 4/2014 Blakely ..... A41D 31/02 2/69
2014/0165427 A1 6/2014 Molyneux et al.
2014/0173938 A1 6/2014 Beye et al.
2014/0223777 A1 * 8/2014 Whiteman ..... A43B 13/125 36/102
2014/0237850 A1 8/2014 Hull
2015/0075033 A1 * 3/2015 Cross ..... A43B 13/22 36/103
2015/0075034 A1 * 3/2015 Cross ..... A43B 13/22 36/103
2015/0089842 A1 * 4/2015 Zamer-Juarez ..... A43B 13/223 36/103
2015/0245683 A1 * 9/2015 Cross ..... B32B 27/065 36/103
2015/0245685 A1 * 9/2015 Cross ..... A43B 13/187 36/104
2016/0157558 A1 6/2016 Cross

FOREIGN PATENT DOCUMENTS

GB 2463446 A 3/2010
IT WO 2009118055 A1 * 10/2009 ..... A42B 13/184
NL WO 8101234 A1 * 5/1981 ..... A42B 13/184
WO 03022085 A2 3/2003
WO 2004052136 6/2004
WO 2007052054 A1 5/2007

(56) References Cited

FOREIGN PATENT DOCUMENTS

| | | |
|---|---|---|
| WO | 2012171911 A1 | 12/2012 |
| WO | 2014018500 | 1/2014 |
| WO | 2015041796 | 3/2015 |

OTHER PUBLICATIONS

International Search Report and Written Opinion dated Jan. 28, 2016 in PCT Application No. PCT/US2015/055652.
International Search Report and Written Opinion for Application No. PCT/US2014/052038, dated Dec. 4, 2014.
International Search Report arid Written Opinion dated Jan. 29, 2016 in PCT Application No. PCT/US2015/055642.
Partial Search Report dated Jan. 22, 2016 in PCT Application No. PCT/US2015/055635.
Office Action dated Aug. 30, 2016 for U.S. Appl. No. 14/564,694.
Office Action dated Aug. 29, 2016 for U.S. Appl. No. 14/564,797.

* cited by examiner

FOOTWEAR WITH AUXETIC GROUND ENGAGING MEMBERS

This application is related to co-pending U.S. patent application Ser. No. 14/564,694, filed Dec. 9, 2014, published as US 2016/0157553, titled "Footwear with Flexible Auxetic Ground Engaging Members," the entirety of which is herein incorporated by reference. This application is also related to co-pending U.S. patent application Ser. No. 14/564,797, filed Dec. 9, 2014, published as US 2016/0157557, titled "Footwear with Flexible Auxetic Sole Structure," the entirety of which is herein incorporated by reference.

BACKGROUND

The present embodiments relate generally to a sole structure for an article of footwear and, more particularly, to an article of footwear with ground engaging members. It is advantageous, when participating in various activities, to have footwear that provides traction and stability on the surface upon which the activities take place. Accordingly, sole structures for articles of footwear have been developed with traction systems that include ground engaging members to provide traction on a variety of surfaces. Examples include cleated shoes developed for outdoor sports, such as soccer, football, and baseball. In some cases, the shape and orientation of ground engaging members on a sole structure may be configured particularly for forward and rearward traction.

SUMMARY

In one aspect, the present disclosure is directed to a sole structure for an article of footwear, where the sole structure includes an outer member and a plurality of ground engaging members extending away from a base portion of the outer member. Furthermore, the plurality of ground engaging members comprise at least a first ground engaging member. The first ground engaging member comprises at least a first arm portion, where the first arm portion has two faces. The two faces include a first face and a second face, and the two faces are joined along a first hinge portion. The first face is attached to the outer member along a second hinge portion, and the second face is attached to the outer member along a third hinge portion. The free end of the first ground engaging member is an apex. One end of the first face is associated with the apex, and one end of the second face is associated with the apex as well. The first ground engaging member includes a first configuration and a second configuration, where the apex has a first height with respect to the base portion in the first configuration, and where the apex has a second height with respect to the base portion in the second configuration. The first hinge portion, the second hinge portion, and the third hinge portion facilitate the transition of the first ground engaging member between the first configuration and the second configuration. The sole structure at least partially comprises an auxetic structure, where the plurality of ground engaging members are arranged on the outer member to provide the sole structure with the auxetic structure.

In another aspect, the present disclosure is directed to a sole structure for an article of footwear. The sole structure includes an outer member and a plurality of ground engaging members extending away from a base portion of the outer member. Furthermore, the plurality of ground engaging members have at least a first ground engaging member.

The first ground engaging member has a first arm portion, a second arm portion, and a third arm portion. The first arm portion includes a first face and a second face, where the first face and the second face are joined along a first hinge portion. The second arm portion includes a third face and a fourth face, where the third face and the fourth face are joined along a second hinge portion. The third arm portion includes a fifth face and a sixth face, where the fifth face and the sixth face are joined along a third hinge portion. The first face is attached to the outer member along a fourth hinge portion, the second face is attached to the outer member along a fifth hinge portion, the third face is attached to the outer member along a sixth hinge portion, the fourth face is attached to the outer member along a seventh hinge portion, the fifth face is attached to the outer member along an eighth hinge portion, and the sixth face is attached to the outer member along a ninth hinge portion. In addition, the first arm portion and the second arm portion are joined along a tenth hinge portion, the second arm portion and the third arm portion are joined along an eleventh hinge portion, and the third arm portion and the first arm portion are joined along a twelfth hinge portion. A free end of the first ground engaging member is an apex. In addition, the sole structure at least partially comprises an auxetic structure, and the plurality of ground engaging members are arranged on the outer member to provide the sole structure with the auxetic structure.

In another aspect, the present disclosure is directed to an article of footwear, including an upper and a sole structure. The sole structure comprises an outer member and a plurality of convex ground engaging members extending away from a base portion of the outer member, where the plurality of convex ground engaging members are surrounded by a plurality of outer member areas. The plurality of convex ground engaging members include a first ground engaging member, a second ground engaging member, and a third ground engaging member. The first ground engaging member includes a first arm portion, the second ground engaging member includes a second arm portion, and the third ground engaging member includes a third arm portion. The first arm portion includes a first face, the second arm portion includes a second face, and the third arm portion includes a third face. The plurality of outer member areas include a first outer member area, where the first outer member area is bounded by the first face, the second face, and the third face. The first face is attached to the first outer member area along a first hinge portion, the second face is attached to the first outer member area along a second hinge portion, and the third face is attached to the first outer member area along a third hinge portion. Furthermore, the sole structure at least partially comprises an auxetic structure, where the plurality of convex ground engaging members expand horizontally upon compression. The first face moves about the first hinge portion relative to the first outer member area upon expansion of the first ground engaging member, the second face moves about the second hinge portion relative to the first outer member area upon expansion of the second ground engaging member, and the third face moves about the third hinge portion relative to the first outer member area upon expansion of the third ground engaging member.

Other systems, methods, features and advantages of the embodiment will be, or will become, apparent to one of ordinary skill in the art upon examination of the following figures and detailed description. It is intended that all such additional systems, methods, features and advantages be included within this description and this summary, be within the scope of the embodiment, and be protected by the following claims.

BRIEF DESCRIPTION OF THE DRAWINGS

The embodiment can be better understood with reference to the following drawings and description. The drawings are schematic and, therefore, the components in the figures are not necessarily to scale, emphasis instead being placed upon illustrating the principles of the embodiment. Moreover, in the figures, like reference numerals designate corresponding parts throughout the different views.

DETAILED DESCRIPTION

Figure 1:
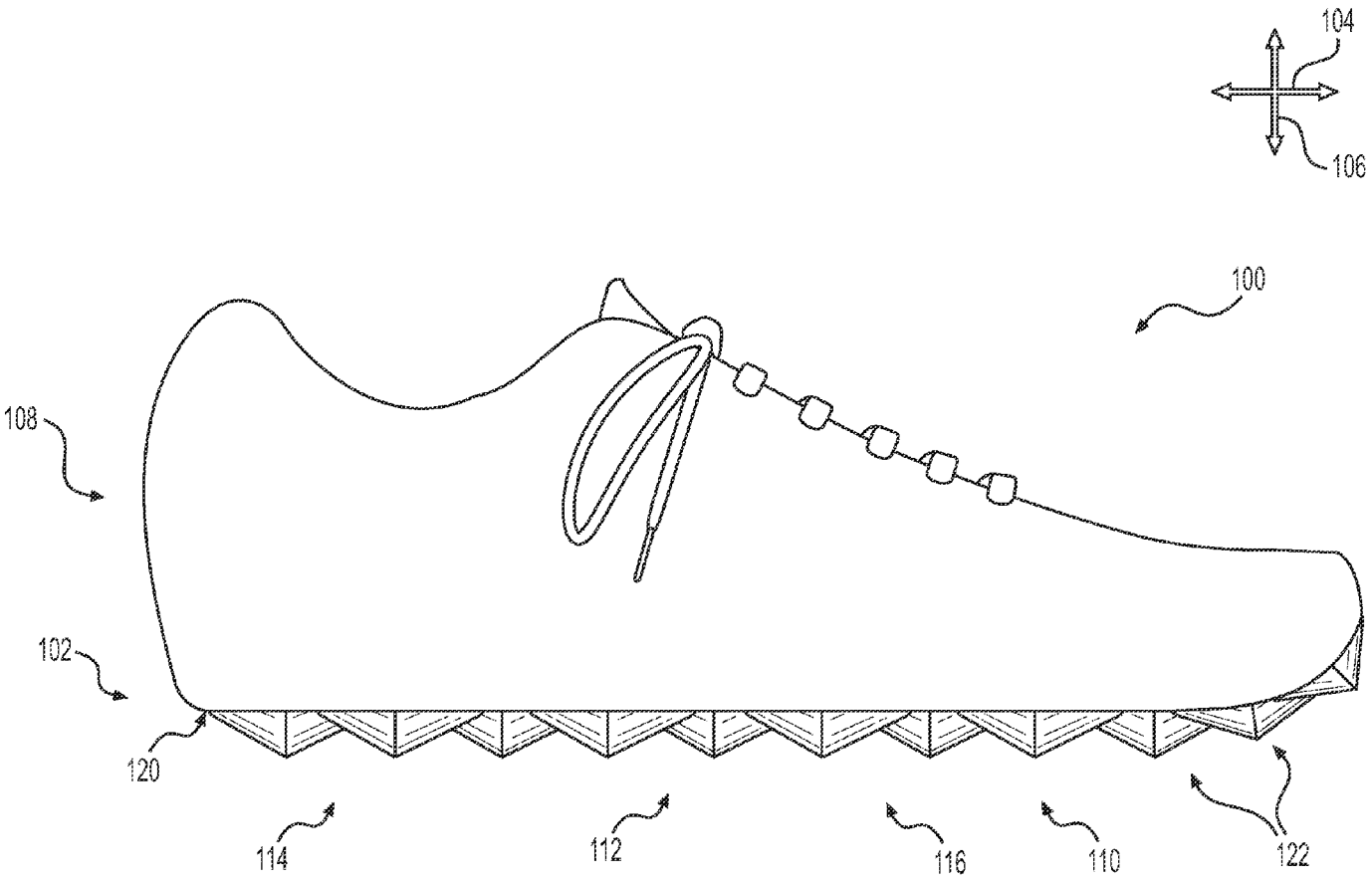
FIG. 1 is a side view of an embodiment of an article of footwear having a sole structure with ground engaging members.

The following discussion and accompanying figures disclose a sole structure for an article of footwear. Concepts associated with the footwear disclosed herein may be applied to a variety of athletic footwear types, including soccer shoes, baseball shoes, football shoes, and golf shoes, for example. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot portion to a heel portion of the sole. The term "longitudinal axis," as used throughout this detailed description and in the claims, refers to an axis oriented in a longitudinal direction.

The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot. The term "lateral axis," as used throughout this detailed description and in the claims, refers to an axis oriented in a lateral direction.

The term "horizontal," as used throughout this detailed description and in the claims, refers to any direction substantially parallel with the longitudinal direction, the lateral direction, and all directions in between. In cases where an article is planted on the ground, a horizontal direction may be parallel with the ground. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions, along a vertical axis. For example, in cases where a sole is planted flat on a ground surface, the vertical direction may extend from the ground surface upward. It will be understood that each of these directional adjectives may be applied to individual components of a sole. Furthermore, the term "outer surface," or "outer side" as used throughout this detailed description and in the claims, refers to the surface of a component that would be facing away from the foot when worn by a wearer. "Inner surface," or "inner side" as used throughout this detailed description and in the claims, refers to the surface of a component that is facing inward, or the surface that faces toward the foot when worn by a wearer.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "permanently attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, and/or other joining techniques. In addition, two components may be permanently attached by virtue of being integrally formed, for example, in a molding process.

FIG. 1 depicts a side-view of one embodiment of an article of footwear ("article") 100, which may include a sole structure 102 and an upper 108 configured to receive a foot. Sole structure 102 may be permanently attached to a bottom portion of upper 108. As shown in FIG. 1 for reference purposes, article 100 may be divided into three general regions, including a forefoot region 110, a midfoot region 112, and a heel region 114. Forefoot region 110 generally includes portions of article 100 corresponding with the toes and the joints connecting the metatarsals with the phalanges. Midfoot region 112 generally includes portions of article 100 corresponding with an arch area of the foot. Heel region 114 generally corresponds with rear portions of the foot, including the calcaneus bone. Forefoot region 110, midfoot region 112, and heel region 114 are not intended to demarcate precise areas of article 100. Rather, forefoot region 110, midfoot region 112, and heel region 114 are intended to represent general relative areas of article 100 to aid in the following discussion.

The accompanying figures depict various embodiments of article 100, having sole structures 102 suited for multi-directional traction on natural and/or synthetic turf. Article 100, as depicted, may be suited for a variety of activities on natural and/or synthetic turf, such as agility/speed training and competition, as well as other sports, such as baseball, soccer, American football, and other such activities where traction and grip may be significantly enhanced by cleat members. In addition, various features of the disclosed sole structures 102 (and/or variations of such features) may be implemented in a variety of other types of footwear.

As sole structure 102 and upper 108 both span substantially the entire length of article 100 along a longitudinal direction 104, the terms forefoot region 110, midfoot region 112, and heel region 114 apply not only to article 100 in general, but also to sole structure 102 and upper 108, as well as the individual elements of sole structure 102 and upper 108.

In different embodiments, upper 108 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. Upper 108 may alternatively implement any of a variety of other configurations, materials, and/or closure mechanisms.

In different embodiments, sole structure 102 may have a configuration that extends between a bottom surface of upper 108 and the ground in a vertical direction 106 and may be secured to upper 108 in any suitable manner. For example, sole structure 102 may be secured to upper 108 by adhesive attachment, stitching, welding, or any other suitable method. Sole structure 102 may include provisions for attenuating ground reaction forces (that is, cushioning and stabilizing the foot during vertical and horizontal loading) in some embodiments. In addition, sole structure 102 may be configured to provide traction, impart stability, and/or limit various foot motions, such as pronation, supination, and/or other motions.

In different embodiments, the configuration of sole structure 102 may vary significantly according to one or more types of ground surfaces on which sole structure 102 may be used. For example, the disclosed concepts may be applicable to footwear configured for use on indoor surfaces and/or outdoor surfaces. The configuration of sole structure 102 may vary based on the properties and conditions of the surfaces on which article 100 is anticipated to be used. For example, sole structure 102 may vary depending on whether the surface is harder or softer. In addition, sole structure 102 may be tailored for use in wet or dry conditions.

Sole structure 102 may include multiple components in some embodiments, which may individually and/or collectively provide article 100 with a number of attributes, such as support, rigidity, flexibility, stability, cushioning, comfort, reduced weight, traction, and/or other attributes. For example, in some embodiments, sole structure 102 may incorporate incompressible plates, moderators, and/or other elements that attenuate forces, influence the motions of the foot, and/or impart stability, for example. Further, while various types of cleated article 100 may be provided without a midsole, in some embodiments, sole structure 102 may also include a midsole (not shown) or another sole layer disposed between an outer member 116 and upper 108. In some embodiments, an additional sole layer disposed between outer member 116 and upper 108 may include cushioning members, reinforcing structures, support structures, or other features. In another embodiment, a midsole may include a recess to hold outer member 116. In other embodiments, a midsole may not be included in sole structure 102 and/or outer member 116 may be joined directly to upper 108.

Article of footwear 100 according to the present disclosure may include a sole structure 102 with outer member 116. In different embodiments, outer member 116 may include features that provide traction and stability on any of a variety of surfaces, and in any of a variety of conditions. In some embodiments, outer member 116 may include a base portion 120 along its outer side that is joined to one or more ground engaging members 122. In some embodiments, ground engaging members 122 extend away from base portion 120 of outer member 116. In one embodiment, ground engaging members 122 may be permanently attached to the base portion 120 of outer member 116. In other embodiments, ground engaging member 122 may be attached in non-permanent manner. In some embodiments, ground engaging members 122 may be cleats or structures substantially similar to cleats. In other embodiments, ground engaging members 122 may be convex portions, or convex members. In some embodiments, ground engaging members 122 may vary in height from one another. In another embodiment, as shown in FIG. 1, ground engaging members 122 may have substantially similar heights throughout outer member 116. Embodiments of such structures are discussed in greater detail below.

In different embodiments, outer member 116 may include a substantially flat or plate-like element that supports the foot, and serves as a platform from which ground engaging members 122 may extend. In some embodiments, outer member 116, although relatively flat, may include various anatomical contours, such as the inner surface of outer member 116 associated with forefoot region 110 being curved higher than an area associated with midfoot region 112, a higher arch support region, and other anatomical features.

Embodiments of ground engaging members 122 may have one or more features that provide increased traction, directional traction, ground penetration, and/or ground extraction. Such features may include, for example, shapes, sizes, positioning on the outer member, as well as the orientation of ground engaging members 122.

Figure 2:
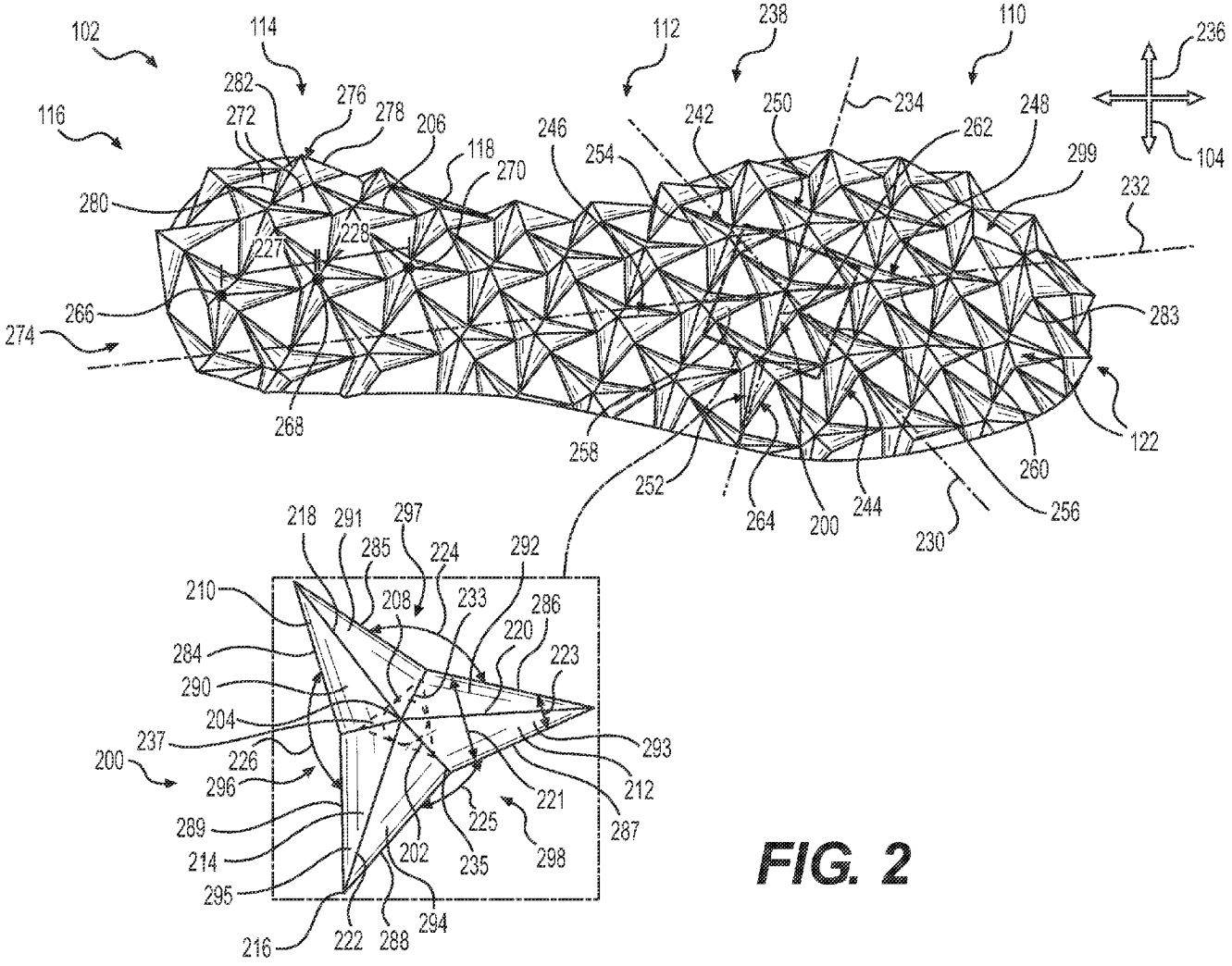
FIG. 2 is an illustration of the outer surface of an embodiment of an outer member for an article of footwear.

FIG. 2 is a view of the bottom surface corresponding to an outer side 299 of an embodiment of sole structure 102. FIG. 2 depicts the outer surface of sole structure 102, comprising outer member 116, and ground engaging members 122. An enlarged view of a first ground engaging member 200 is included for purposes of illustration.

In the embodiment shown in FIG. 2, ground engaging members 122 and other portions of outer member 116 may be configured in a geometric pattern that provides an auxetic structure to at least some portions of sole structure 102. As will be described in greater detail below with respect to FIGS. 2-15, sole structure 102 may include an auxetic structure that, when placed under tension in a first direction, can increase in size both in the first direction and in the direction in the plane of the structure that is orthogonal to the first direction. In some embodiments, outer member 116 may be at least partially an auxetic structure. A structure that deforms due to its auxetic properties may be said to undergo an auxetic action.

As used herein, the terms "auxetic" generally refers to materials that have a negative Poisson's ratio, such that when they are under tension in a first direction, their dimensions increase both in the first direction and in a direction orthogonal the first direction. Articles of footwear having soles with an auxetic structure are described in Cross, U.S. patent application Ser. No. 14/030,002, filed Sep. 18, 2013 and titled "Auxetic Structures and Footwear with Soles Having Auxetic Structures", which is incorporated by reference above. In some cases, the term "reactive structure" may also be used to describe an auxetic structure.

For example, if the structure can be described as having a length, a width and a thickness, then when the structure is under tension longitudinally, the structure increases in width. In some embodiments, the auxetic structures are bi-directionally auxetic such that they increase in length and width when stretched longitudinally and in width and length when stretched laterally, but do not increase in thickness. Also, although such auxetic structures will generally have at least a monotonic relationship between the applied tension and the increase in the dimension orthogonal to the direction of the tension, that relationship need not be proportional or linear, and in general need only increase in response to increased tension. Thus, in one embodiment, outer member 116 can expand in a first direction and a second direction when outer member 116 is tensioned in the first direction, where the second direction is substantially perpendicular to the first direction.

In different embodiments, ground engaging members 122 may be used to form auxetic structures in sole structure 102. In some embodiments, ground engaging members 122 may comprise portions that can project outwardly from the base of a sole structure. For example, in some embodiments, sole structure 102 or portions of soles structure 102 may incorporate any of the structures disclosed in Nordstrom, U.S. Patent Publication Number 2014/0053311, published Feb. 27, 2014 (now U.S. patent application Ser. No. 14/011,201, filed Aug. 27, 2013) and titled "Dynamic Materials Integrated Into Articles for Adjustable Physical Dimensional Characteristics," which is incorporated by reference in its entirety herein. In different embodiments, portions may be any shape, size, or geometry. In some embodiments, various polygonal features or portions may be used to form the auxetic structures, such as triangular, quadrilateral, pentagonal, hexagonal, heptagonal or octagonal features. In other embodiments, portions may be polygonal features used to form three-pointed star-shaped projections, four-pointed star-shaped projections, five-pointed star-shaped projections, or six-pointed star-shaped projections. In the embodiment of FIG. 2, the portions are depicted as ground engaging members 122 that include generally triangular features forming three-pointed star-shaped pyramidal structures or projections. In one embodiment, ground engaging members may have the approximate geometry of a pyramid with a tri-star base.

Thus, in different embodiments, ground engaging members 122 may be configured in varying geometric patterns. In some embodiments, ground engaging members 122 may include convex features. In other embodiments, ground engaging members 122 may include various hinges or predetermined regions of bending. In one embodiment, when ground engaging members 122 are vertically compressed they can unfold and extend in a horizontal direction. In some embodiments, there may be multiple ground engaging members 122 arranged on sole structure 102, and in one embodiment, ground engaging members 122 may function together to provide auxetic structure to sole structure 102. For example, in one embodiment, as shown with respect to first ground engaging member 200 in FIG. 2, one or more of ground engaging members 122 may have a substantially three-pointed star cross-sectional shape in a substantially horizontal plane. In some embodiments, one or more ground engaging members 122 may have a substantially three-pointed star cross-sectional shape over substantially the entire height of ground engaging member 122. Accordingly, first ground engaging member 200 may extend from a region of outer member 116 in a substantially three-pointed star shape to a central tip 202 located around an apex 204 of first ground engaging member 200. Apex 204 may represent the point on first ground engaging member 200 farthest from outer member 116.

In different embodiments, ground engaging members 122 may include one or more arm portions 206. In some embodiments, arm portions 206 may extend substantially radially from a central region 208, as shown with respect to first ground engaging member 200. In some embodiments, one or more arm portions 206 may extend in a substantially non-radial direction from central region 208. In other embodiments, all arm portions 206 of a single ground engaging member may extend radially from central region 208 of the ground engaging member.

In some embodiments, central region 208 may include different shapes. In the embodiment of FIG. 2, central region 208 includes a triangular shape in the horizontal plane. In other embodiments, central region 208 may include a circular, square, or other polygonal shape. Central region 208 and central tip 202 are not intended to demarcate a precise area of the ground engaging member. Rather, they are intended to represent general relative areas of the ground engaging member to aid in the following discussion.

In some embodiments, a majority of ground engaging members 122 may each include three arm portions 206, extending outward in a radial direction. For example, in FIG. 2, first ground engaging member 200 shown in the enlarged view includes a first arm portion 210, a second arm portion 212, and a third arm portion 214. Each arm portion begins near central region 208 and terminates at a vertex 216. A midline on each arm portion may be seen that moves from apex 204 to each vertex 216. First arm portion 210 includes a first midline 218, second arm portion 212 includes a second midline 220, and third arm portion 214 includes a third midline 222.

In different embodiments, arm portions 206 may have various shapes. In some embodiments, arm portions 206 may include a generally triangular shape. In other embodiments, vertices 216 may include an intersection of edges that is more pointed, or less pointed, than that depicted in FIG. 2. In other words, edge of vertex 216 may be more or less narrow or sharp. Furthermore, arm portions 206 may be non-linear in some embodiments. For example, in some embodiments, arm portions 206 may extend outward from central region 208 and include a curved geometry. In different embodiments, first arm portion 210, second arm portion 212, and third arm portion 214 of first ground engaging member 200 may be shaped similarly to one another, or they may each have different shapes.

In different embodiments, the width of an arm portion 206 in the horizontal plane may vary from central region 208 to vertex 216. In some embodiments, there can be a first width 221 that is closer to central region 208, and a second width 223 that is closer to vertex 216. In some embodiments, first width 221 is larger than second width 223. In other embodiments, first width 221 may be substantially equivalent to second width 223, or may be smaller.

In some embodiments, the geometry of ground engaging members 122 can generally demarcate outer surface of outer member 116 into smaller areas. As seen in FIG. 2, outer member 116 includes a regular pattern of outer member areas 272 that lie between or adjacent to arm portions 206 of adjacent ground engaging members 122. In some embodiments, outer member areas 272 may be generally triangular. In other embodiments, outer member 116 may be demarcated in a different arrangement or geometrical pattern and provide outer member areas 272 of different shape or size. In some embodiments, outer member areas 272 may be curved or otherwise irregular, rather than linearly shaped. In other embodiments, the appearance of outer member areas 272 may be related to the shape, size, and arrangement of ground engaging members 122 included.

In some embodiments, different areas of a ground engaging member may function as a hinge, permitting the turning or movement of adjacent parts. In particular, in some embodiments, edges connecting adjacent portions of material may rotate about a hinge portion 283 associated with the edge of the ground engaging member. In different embodiments, ground engaging members 122 may include one or more hinge portions 283. In some embodiments, each arm portion 206 of ground engaging members 122 may include one or more hinge portions 283. Hinge portions 283 may at least in part provide sole structure 102 with the auxetic properties described in this description. In other words, ground engaging members 122 may be able to move about the regions associated with hinge portions 283 in some embodiments. In some embodiments, at least some of hinge portions 283 may be rounded with a convex geometry.

In one example, each edge of ground engaging member 200 can be associated with a corresponding hinge portion 283. In FIG. 2, it can be seen that first ground engaging member 200 includes twelve hinge portions. First arm portion 210 includes a first hinge portion 284 and a second hinge portion 285. Second arm portion 212 includes a third hinge portion 286 and a fourth hinge portion 287. Third arm portion 214 includes a fifth hinge portion 288 and a sixth hinge portion 289. Furthermore, first midline 218 of first arm portion 210 may be associated with a seventh hinge portion, second midline 220 of second arm portion 212 may be associated with an eighth hinge portion, and third midline 222 of third arm portion 214 may be associated with a ninth hinge portion. In addition, first arm portion 210 of first ground engaging member 200 may be disposed adjacent to and joined along a tenth hinge portion 233 to neighboring second arm portion 212. Likewise, second arm portion 212 may be joined along an eleventh hinge portion 235 to adjacent third arm portion 214. Third arm portion 214 may also be joined along a twelfth hinge portion 237 to first arm portion 210. In other embodiments, arm portions 206 may include a lesser or greater number of hinge portions 283.

In some embodiments, each of the remaining edges and/or midlines of ground engaging members 122 may be associated with hinged areas or hinge portions that join adjacent polygonal portions in a rotatable manner. The characteristics of hinge portions 283 may be related to the type of shape or geometry selected for ground engaging members 122. In other embodiments, ground engaging members 122 may not include hinge portions 283.

In different embodiments, hinge portions 283 can be associated with and/or comprised of a relatively small portion of material adjoining or connecting various faces, or sides, of the various polygonal or irregular portions forming the auxetic structure. In some embodiments, ground engaging members 122 include a plurality of faces. In one embodiment, the faces associated with ground engaging members 122 are substantially flat.

Hinge portions 283 may also provide a connecting portion between arm portions 206 and a portion of outer member 116, such as outer member areas 272. In other words, some hinge portions 283 may provide a region of attachment for the various faces or portions comprising ground engaging members 122 to sole structure 102 and/or outer member 116.

In some embodiments, ground engaging members 122 may include six faces. For example, in FIG. 2, a first face 290 and a second face 291 forming two sides or portions of first arm portion 210 are depicted. First face 290 and second face 291 may be joined, rotated or bent with respect to one another along the seventh hinge portion associated with first midline 218. First face 290 may also be joined, moved, rotated, or bent along first hinge portion 284 with respect to a first outer member area 296 of sole structure 102, and second face 291 may be connected, moved, rotated, or bent along second hinge portion 285, with respect to a second outer member area 297 of sole structure 102. In a similar manner, a third face 292 and a fourth face 293 form two sides or portions of second arm portion 212. Third face 292 and fourth face 293 may join, rotate or bend with respect to one another along the eighth hinge portion associated with second midline 220. Third face 292 may also be joined, moved, rotated or bent along third hinge portion 286 with respect to second outer member area 297, and fourth face 293 may be connected, moved, rotated, or bent along fourth hinge portion 287 with respect to a third outer member area 298. In addition, third arm portion 214 may be comprised of two sides, including a fifth face 294 and a sixth face 295. Fifth face 294 and sixth face 295 may join, rotate or bend with respect to one another at the ninth hinge portion associated with third midline 222. Fifth face 294 may be connected, moved, rotated, or bent along fifth hinge portion 288 with respect to third outer member area 298, and sixth face 295 may be joined, moved, rotated, or bent along sixth hinge portion 289 with respect to first outer member area 296.

As seen in FIG. 2, a portion, or one end, of each face may also be associated with an apex 204. Thus, in one embodiment, each face may extend from base portion 120 to apex 204. In other embodiments, each face may be joined to two adjacent faces.

In some embodiments, two adjacent arm portions 206 may form various angles. In the embodiment of FIG. 2, the three arm portions associated with first ground engaging member 200 form three angles, identified as angle 224, angle 225, and angle 226. First arm portion 210, second arm portion 212, and third arm portion 214 are disposed so that each pair of adjacent arm portions form substantially equivalent obtuse angles. In other embodiments, the angles formed by a pair of adjacent arm portions may differ from one another. In some embodiments, any angles formed by a pair of adjacent arm portions may be acute or right angled. It should be noted that the magnitudes of angle 224, angle 225, and angle 226 may increase or decrease as the auxetic structure of sole structure 102 undergoes expansion or compression. In particular, as tenth hinge portion 233, eleventh hinge portion 235, and/or twelfth hinge portion 237 permit movement of various regions of first ground engaging member 200, corresponding angle 224, angle 225, and angle 226 can change.

In different embodiments, the orientation of one or more arm portions 206 may differ significantly, or may be substantially similar. In the embodiment of FIG. 2, first arm portion 210, second arm portion 212, and third arm portion 214 are each oriented along a different direction. In other words, each midline of first arm portion 210, second arm portion 212, and third arm portion 214 is oriented along a different axis. In some embodiments, first midline 218 may be oriented along a first direction 230, second midline 220 may be oriented along a second direction 232, and third midline 222 may be oriented along a third direction 234. As seen in FIG. 2, first direction 230 and third direction 234 are oriented so that they extend diagonally relative to a lateral direction 236, extending from a medial side 238 to a lateral side 240 of sole structure 102. Second direction 232 is oriented so that it extends approximately from forefoot region 110 to heel region 114 of sole structure 102.

In different embodiments, the orientation of adjacent ground engaging members 122 may vary or be substantially similar to the orientation of first ground engaging member 200. In other words, the midlines of arm portions 206 of ground engaging members 122 may lie along or near substantially the same axis as the respective midlines of the three arm portions of first ground engaging member 200 in some embodiments. For example, in FIG. 2, ground engaging members adjacent to first ground engaging member 200 include second ground engaging member 242, third ground engaging member 244, fourth ground engaging member 246, fifth ground engaging member 248, sixth ground engaging member 250, and seventh ground engaging member 252. The midlines of a first arm portion 254 of second ground engaging member 242, first arm portion 210 of first ground engaging member 200, and a first arm portion 256 of third ground engaging member 244 may generally lie along first direction 230. The midlines of a second arm portion 258 of fourth ground engaging member 246, second arm portion 212 of first ground engaging member 200, and a second arm portion 260 of fifth ground engaging member 248 may generally lie along second direction 232. The midlines of a third arm portion 262 of sixth ground engaging member 250, third arm portion 214 of first ground engaging member 200, and a third arm portion 264 of seventh ground engaging member 252 may lie along third direction 234. In some embodiments, other ground engaging members 122 may include arm portions 206 that lie along axes that are substantially parallel to first direction 230, second direction 232, and third direction 234.

In other embodiments, ground engaging members 122 may be disposed along different orientations or arrangements. It should be noted that in different embodiments, first direction 230, second direction 232, third direction 234, and/or any other axis along which ground engaging members are arranged may be non-linear. In some embodiments, adjacent ground engaging members 122 may lie along an axis that is curved, for example. In other embodiments, ground engaging members 122 may be disposed in a staggered arrangement.

Providing all, or substantially all, of ground engaging members 122 so that an arm portion generally lies along first direction 230, second direction 232, or third direction 234, or axes parallel to first direction 230, second direction 232, or third direction 234 may maximize the benefits discussed above regarding the characteristics of traction in medial side 238 to lateral side 240 (i.e., side-to-side) directions. Such configurations may provide increased performance in terms of traction supporting agility in lateral direction 236.

In different embodiments, two adjacent ground engaging members 122 may be disposed at various distances from one another. In some embodiments, ground engaging members 122 may be disposed at regular intervals from one another. In other embodiments, there may be greater space, or areas of outer member 116, between one ground engaging member and another ground engaging member. In the embodiment of FIG. 2, first ground engaging member 200 and sixth ground engaging member 250 are adjacent to one another so that third arm portion 262 of sixth ground engaging member 250 generally abuts the area near central region 208 of first ground engaging member 200 within the obtuse angle formed by second arm portion 212 and third arm portion 214 of first ground engaging member 200. Other ground engaging members 122 may be disposed in a similar arrangement adjacent to areas of outer member 116. In one embodiment, ground engaging members 122 that generally lie along a single axis may be disposed so that they are at substantially the same distance from one another. For example, in FIG. 2, a first distance 227 from a first apex 266 to a second apex 268 may be substantially similar to a second distance 228 from second apex 268 to a third apex 270. In other embodiments, first distance 227 may be less than second distance 228, or first distance 227 may be greater than second distance 228.

In some embodiments, particularly near a perimeter 274 of sole structure 102, ground engaging members 122 may be partially formed. In other words, some ground engaging members 122 may be formed with fewer than three arm portions 206, arm portions 206 that extend for shorter lengths, and/or a central region 208 that is smaller relative to the central regions of other ground engaging members disposed farther from perimeter 274. For example, in FIG. 2, an eighth ground engaging member 276 can be seen disposed along perimeter 274 of heel region 114. Eighth ground engaging member 276 includes a first arm portion 278 and a second arm portion 280, similar to arm portions 206 described above. However, a third arm portion 282 of eighth ground engaging member 276 is abbreviated in length relative to first arm portion 278 and second arm portion 280. Thus, in some embodiments, ground engaging members 122 may be formed along or near perimeter 274 of outer member 116 that differ from ground engaging members 122 that are not formed along perimeter 274. In some embodiments, at least one arm portion of each ground engaging member disposed along perimeter 274 may be shorter than the arm portions 206 of the ground engaging members disposed further from perimeter 274. In other embodiments, there may be fewer than three arm portions 206 included for one or more ground engaging members 122 that are disposed along perimeter 274. In one embodiment, a ground engaging member near perimeter 274 may include only a single arm portion 206, or a partially formed arm portion.

Materials and configurations for outer member 116 and ground engaging members 122 may be selected according to the type of activity for which article 100 is configured. Outer member 116 and/or ground engaging members 122 may be formed of suitable materials for achieving the desired performance attributes. In one embodiment, outer member 116 and ground engaging members 122 may be comprised of substantially similar materials. In different embodiments, for example, outer member 116 and/or ground engaging members 122 may be formed of any suitable polymer, rubber, composite, and/or metal alloy materials. Examples of such materials may include thermoplastic and thermoset polyurethane (TPU), polyester, nylon, glass-filled nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In one embodiment, outer member 116 and/or ground engaging members 122 are made of a substantially elastic material.

In some embodiments, outer member 116, or portions of outer member 116 and ground engaging members 122, may be formed of a composite of two or more materials, such as carbon-fiber and poly-paraphenylene terephthalamide. In some embodiments, these two materials may be disposed in different portions of outer member 116 and/or ground engaging members 122. Alternatively, or additionally, carbon fibers and poly-paraphenylene terephthalamide fibers may be woven together in the same fabric, which may be laminated to form outer member 116. Other suitable materials, including future-developed materials, will be recognized by those having skill in the art.

Different structural properties may be desired for different aspects of outer member 116 and/or ground engaging members 122. Therefore, the structural configuration may be determined such that, even though a common material is used for all portions of outer member 116 and/or ground engaging members 122, the different portions may be stiffer, or more flexible due to different shapes and sizes of the components. In different embodiments, for example, heel region 114 and midfoot region 112 of outer member 116 may be formed of a thicker material and/or may include reinforcing features, such as ribs, in order to provide stiffness to these portions of outer member 116, whereas forefoot region 110 of outer member 116, particularly a region of outer member 116 corresponding with the ball of the foot, may be formed of a relatively thin material, in order to provide flexibility to forefoot region 110. Greater flexibility in forefoot region 110 may enable natural flexion of the foot during running or walking, and may also enable outer member 116 to conform to surface irregularities, which may provide additional traction and stability on such surfaces. In addition, ground engaging members 122 may be formed at least in part with a thicker structure to provide rigidity and strength in some embodiments.

In different embodiments, outer member 116 and/or ground engaging members 122 may be formed by any suitable process. For example, in some embodiments, outer member 116 and/or ground engaging members 122 may be formed by molding. In addition, in some embodiments, various elements of outer member 116 and/or ground engaging members 122 may be formed separately and then joined in a subsequent process. Those having ordinary skill in the art will recognize other suitable processes for making outer members 116 and/or ground engaging members 122 discussed in this disclosure.

In some embodiments, outer member 116, ground engaging members 122, and other elements of outer member 116 may be integrally formed. For example, in some embodiments, the entirety of outer member 116 may be formed of a single material, forming all parts of outer member 116. In such embodiments, outer member 116 may be formed all at once in a single molding process, for example, with injection molding.

In other embodiments, different portions of sole structure 102 may be formed of different materials. For example, a stiffer material, such as carbon fiber, may be utilized in heel region 114 and/or midfoot region 112 of outer member 116, whereas a more flexible material, such as a thin polyurethane, may be used to form forefoot region 110 of outer member 116. In addition, it may be desirable to utilize a stiffer and/or harder material for outer member 116 in some embodiments, such as carbon-fiber and/or polyurethane, and softer and more flexible material for ground engaging members 122, such as a relatively hard rubber. For example, some parts of outer member 116 may be made by molding a hard rubber or polyurethane to form the polygonal features.

Accordingly, in some embodiments, outer member 116 and/or ground engaging members 122 may be formed by multiple molding steps, for example, using a co-molding process. For instance, outer member 116 may be pre-molded, and then inserted into an outer member mold, into which the ground engaging member material may be injected to form ground engaging members 122, or portions of ground engaging members 122. In other embodiments, ground engaging members 122 may be pre-molded and outer member 116 may be co-molded with the pre-formed ground engaging members. In addition, other components of outer member 116, such as reinforcing elements, may be formed of different materials.

In some embodiments, outer member 116 and ground engaging members 122 may be made separately and then engaged with one another (e.g., by mechanical connectors, by cements or adhesives, etc.). In some embodiments, ground engaging members 122 and other sole components may be integrally formed as a unitary, one piece construction (e.g., by a molding step). In some embodiments, at least some portions of sole structure 102 (e.g., outsole or outer member components) may be affixed to one another or formed together as a unitary, one-piece construction, e.g., by selective laser sintering, stereolithography, or other three dimensional printing or rapid manufacturing additive fabrication techniques. These types of additive fabrication techniques allow the ground engaging members 122, outer member 116, and/or other components of sole structure 102 to be built as unitary structures.

Figure 3:
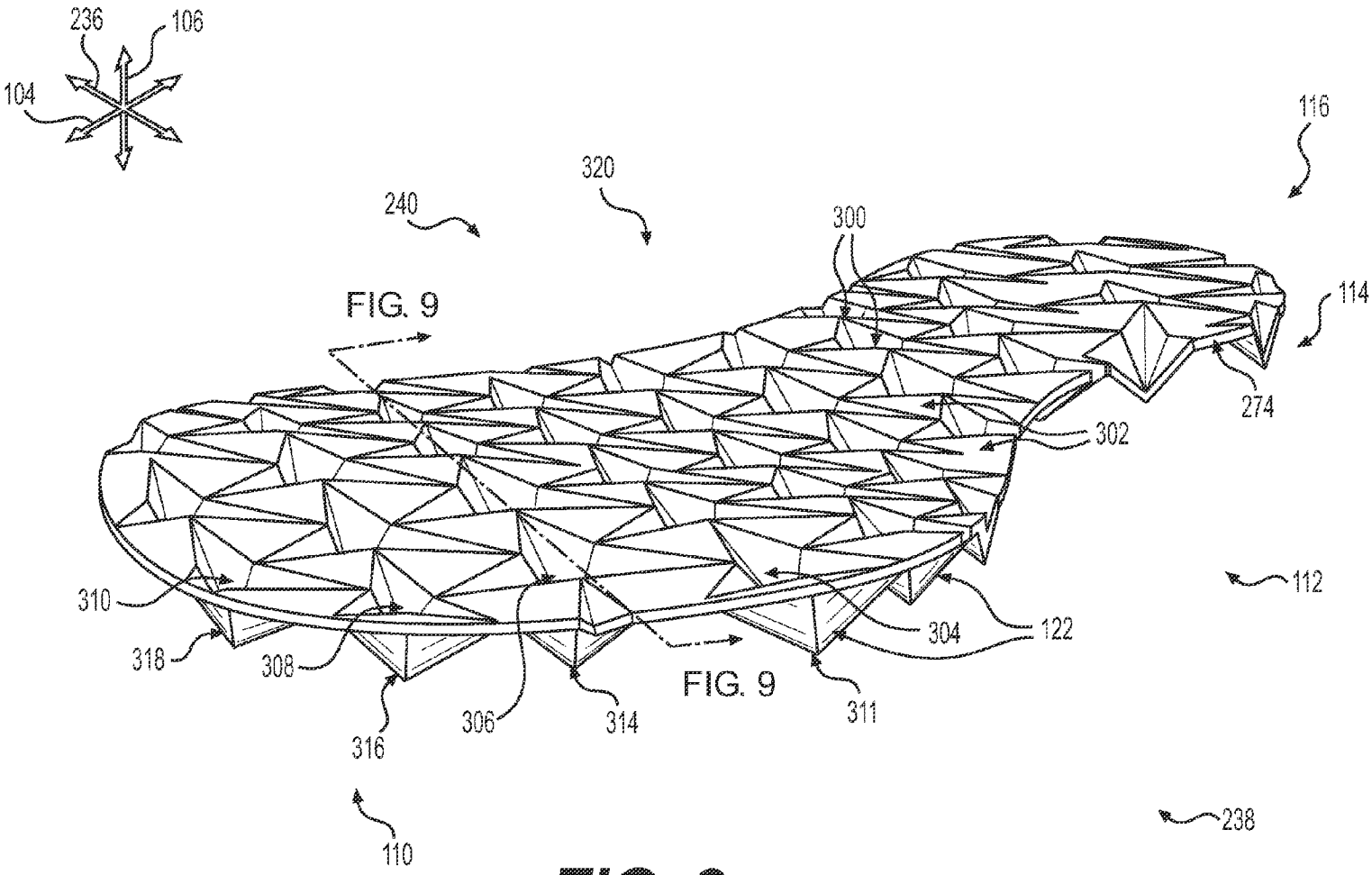
FIG. 3 is an isometric illustration of the inner surface of an embodiment of an outer member for an article of footwear.

FIG. 3 illustrates an isometric view of an inner side 320 of an embodiment of outer member 116 for a sole structure. Outer member 116 may include apertures 300 disposed along inner surface or inner side 320 of outer member 116 in some embodiments. In one embodiment, apertures 300 may comprise a hollow interior region that is bounded by the plurality of faces associated with ground engaging members 122 on the outer side of outer member 116. The hollow interior region can be open on an inner side of outer member 116. In particular, apertures 300 may correspond to a concave interior side of ground engaging members 122. Apertures 300 may extend in vertical direction 106 through outer member 116.

In different embodiments, apertures 300 may be configured in varying geometric patterns. In some embodiments, apertures 300 may include concave features. In other embodiments, apertures 300 may include various hinges or predetermined regions of bending. In one embodiment, when apertures 300 are vertically compressed they can unfold and extend in a horizontal direction. In some embodiments, there may be multiple apertures 300 arranged on sole structure 102, and in one embodiment, apertures 300 may function together to provide auxetic structure to outer member 116.

In some embodiments, apertures 300 may comprise openings in outer member 116. In different embodiments, apertures 300 may be any shape, size, depth, or geometry. In some embodiments, various polygonal openings or other irregularly shaped openings may be used to form apertures 300, such as triangular, quadrilateral, pentagonal, hexagonal, heptagonal, octagonal, or other irregular features. In other embodiments, apertures 300 may be polygonal, and may form three-pointed star-shaped openings, four-pointed star-shaped openings, five-pointed star-shaped openings, or six-pointed star-shaped openings.

In one example, as shown in FIG. 3, inner side 320 of outer member 116 bears a pattern of triangular, or three-pointed, star-shaped apertures 300, bounded by a pattern of base areas 302. In different embodiments, base areas 302 may be configured in varying geometric patterns. In some embodiments, base areas 302 may include generally flat or plate-like features. In other embodiments, base areas 302 may include various hinges or predetermined regions of bending for greater flexibility. In other embodiments base areas 302 may be relatively inflexible. In some embodiments, there may be multiple base areas 302 arranged on sole structure 102, and in one embodiment, base areas 302 may function together to provide auxetic structure to outer member 116.

In some embodiments, base areas 302 may comprise variously shaped portions in outer member 116. In different embodiments, base areas 302 may be any shape, size, thickness, or geometry. In some embodiments, various polygonal shapes or other irregularly shape portions may comprise base areas 302, such as round, curved, elliptical, triangular, quadrilateral, pentagonal, hexagonal, heptagonal, octagonal, or other irregular features. In one embodiment, base areas 302 may be generally triangular.

In one case, base areas 302 may be separated by apertures 300 so that base areas 302 are completely enclosed and separated from one another. In other cases, base areas 302 are partially enclosed so that some base areas 302 can touch or abut adjacent base areas 302, as depicted in FIG. 3.

In different embodiments, apertures 300 may be disposed in various arrangements along outer member 116. In some embodiments, apertures 300 may be disposed in a uniform pattern along outer member 116. In other embodiments, apertures 300 may be disposed in only some areas of outer member 116.

In different embodiments, apertures 300 may align or correspond with ground engaging members 122 that are located on the outer side of outer member 116. In other embodiments, ground engaging members 122 may be disposed on outer side of outer member 116, but the opposite side of outer member 116 may be solid, or "filled in," so that there is no corresponding aperture 300. In one embodiment, apertures 300 may be present but there may be no corresponding ground engaging member 122. In another embodiment, there may be ground engaging members 122 and corresponding apertures 300, but they may differ significantly in size or shape from one another. In the embodiment of FIG. 3, apertures 300 generally correspond to ground engaging members 122 disposed on the opposite side of outer member 116. As seen in forefoot region 110, and along perimeter 274 of outer member 116, there is a first aperture 304 which is aligned with a first ground engaging member 311, a second aperture 306 aligned with a second ground engaging member 314, a third aperture 308 aligned with a third ground engaging member 316, and a fourth aperture 310 aligned with a fourth ground engaging member 318. This type of arrangement may be repeated throughout outer member 116, or it may differ. Moreover, it may be understood that base areas 302 on inner side 320 may generally correspond with outer member areas 272 on outer side 299 of outer member 116.

In some embodiments, the shape of apertures 300 in the horizontal plane may be substantially similar to the shape of corresponding ground engaging members 122 in the horizontal plane. In other embodiments, some areas of outer member 116 may include apertures 300 and ground engaging members 122 that are similar shapes, and other areas may include apertures 300 and ground engaging members 122 are different shapes.

Figure 5:
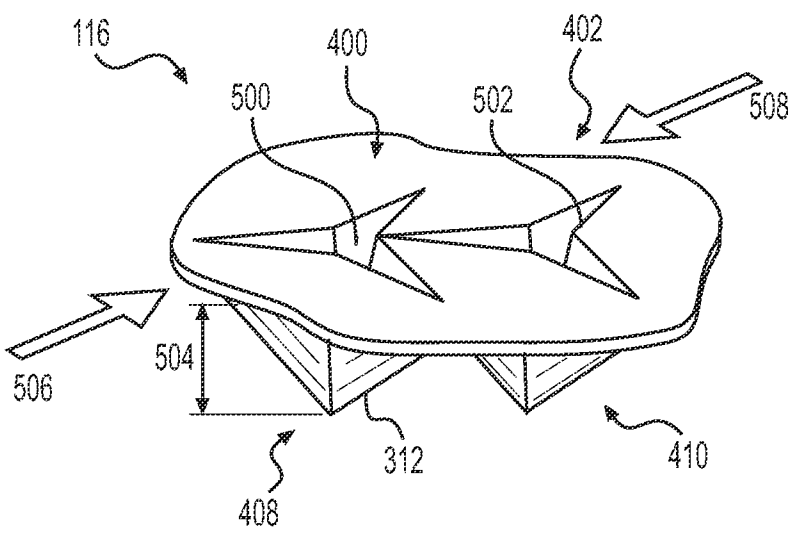
FIG. 5 is an isometric view of the inner surface of an embodiment of a portion of the outer member.
Figure 4:
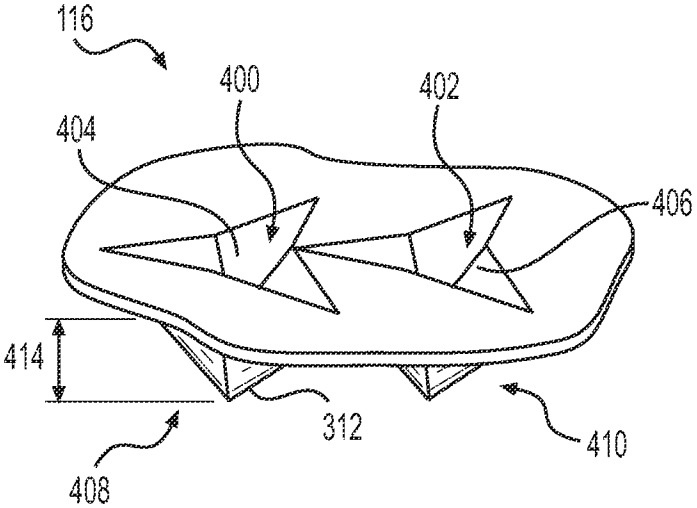
FIG. 4 is an isometric view of the inner surface of an embodiment of a portion of the outer member.

During deformations as described above, ground engaging members 122 may expand or compress in different embodiments in different embodiments. FIGS. 4-8 depict a cutaway portion of outer member 116. In FIGS. 4 and 5, a first aperture 400 and a second aperture 402 in outer member 116 are depicted, with portions of corresponding first ground engaging member 408 and second ground engaging member 410 visible below outer member 116. In FIG. 4, first aperture 400 has an opening with a first aperture area 404, and second aperture 402 similarly has an opening with a second aperture area 406. In some embodiments, the openings lie generally in the horizontal plane along the upper surface of outer member 116. The area of each opening may be enclosed by the perimeter edges of each aperture.

When a compressive force is applied, for example near the perimeter of outer member, the areas of the openings of first aperture 400 and second aperture 402 may change in some embodiments. In FIG. 5, a first compressive force 506 and a second compressive force 508 are represented by arrows. As a result of the application of compressive force 506 and compressive force 508, the areas of first aperture 400 and second aperture 402 have decreased. The opening of first aperture 400 has a third aperture area 500, and the opening of second aperture 402 has a fourth aperture area 502. Third aperture area 500 is less than first aperture area 404 and fourth aperture area 502 is less than second aperture area 406.

In some embodiments, the shape of the apertures may also change. Depending on the magnitude and the direction of the force(s) applied, the changes in area or shape may vary. In some embodiments, a different force may permit an expansion of the aperture areas. For example, in one embodiment, the outer member may be exposed to a force whereby third aperture area 500 is greater than first aperture area 404, and/or fourth aperture area 502 is greater than second aperture area 406. In one embodiment, the area of an aperture may increase when a compressive force is applied in the vertical direction.

Exposure to various forces may also produce a change in the shape or geometry, size, and/or height of ground engaging members. In FIG. 4, first ground engaging member 408 has an apex 312 at a first height 414. In some embodiments, the height of apex 312 lies generally in the vertical plane of the outer member and extends from the bottom side of the outer member toward the ground. For example, when a first force 506 and a second force 508 are applied, the height of first ground engaging member 408 may change. In FIG. 5, the height of apex 312 of first ground engaging member 408 is increased to a second height 504. In the embodiments of FIGS. 4 and 5, second height 504 is greater than first height 414.

In other embodiments, second height 504 may be substantially similar to or less than first height 414 as various forces are applied to article of footwear 100. In some embodiments, the overall geometry of the ground engaging members may also change. Depending on the magnitude and the direction of the force(s) applied, changes in area or shape may vary. In some embodiments, a different force may permit an expansion of the ground engaging member(s). In some cases, this expansion occurs in the horizontal direction. For example, in one embodiment, the outer member may be exposed to a force whereby second height 504 is less than first height 414.

Figure 6:
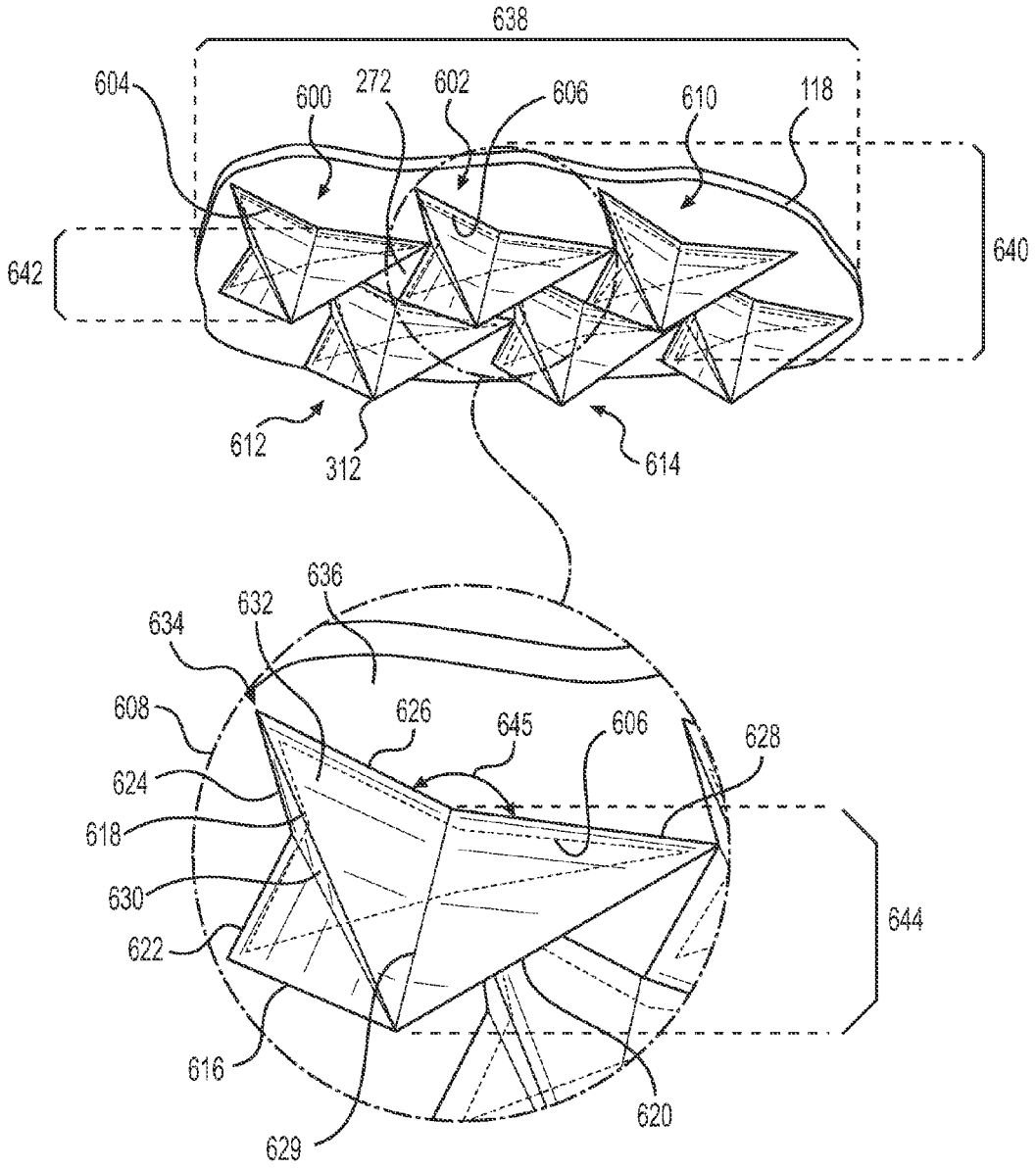
FIG. 6 is an isometric view of the outer surface of an embodiment of a portion of the outer member.
Figure 7:
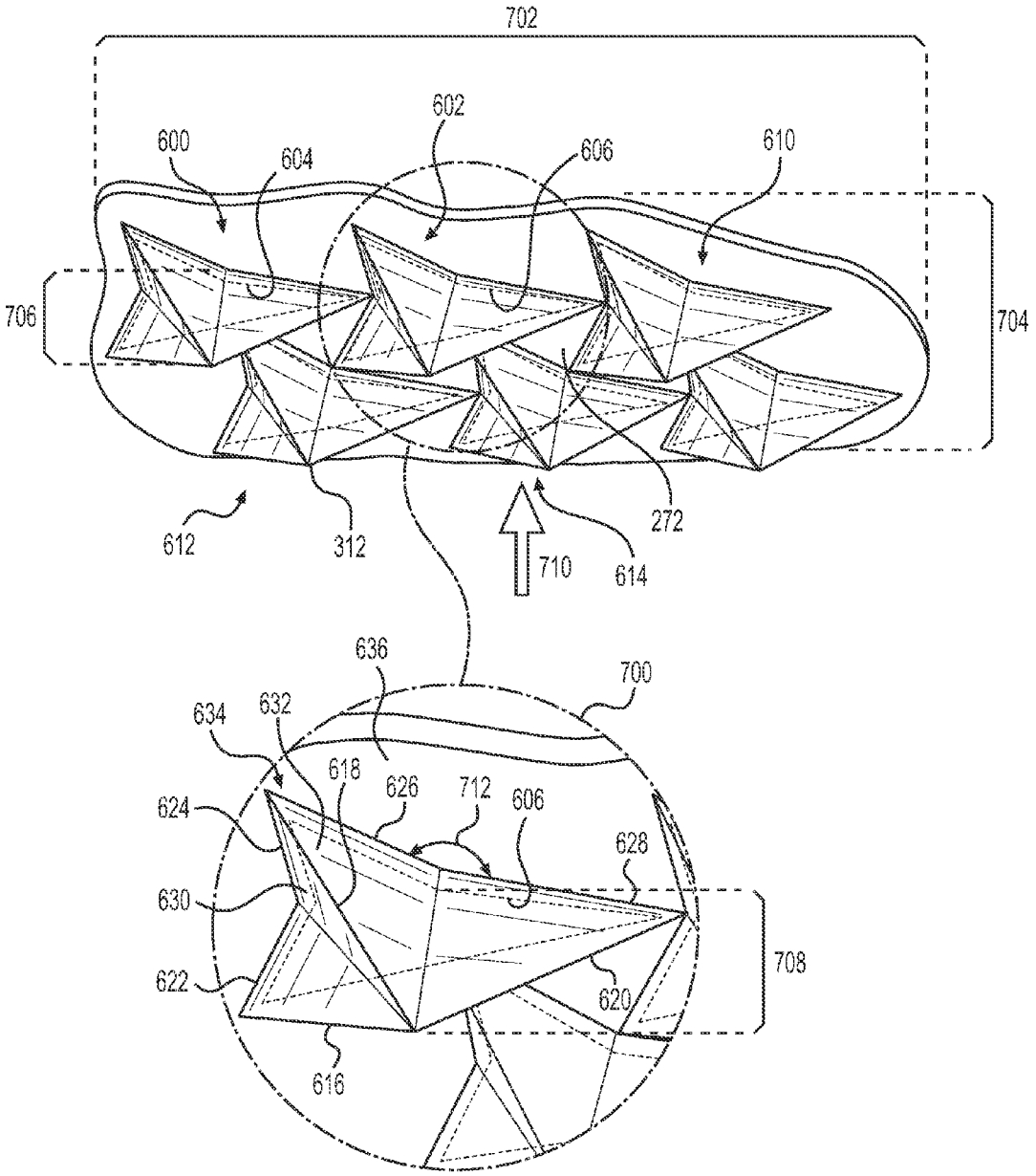
FIG. 7 is an isometric view of the outer surface of an embodiment of a portion of the outer member.
Figure 8:
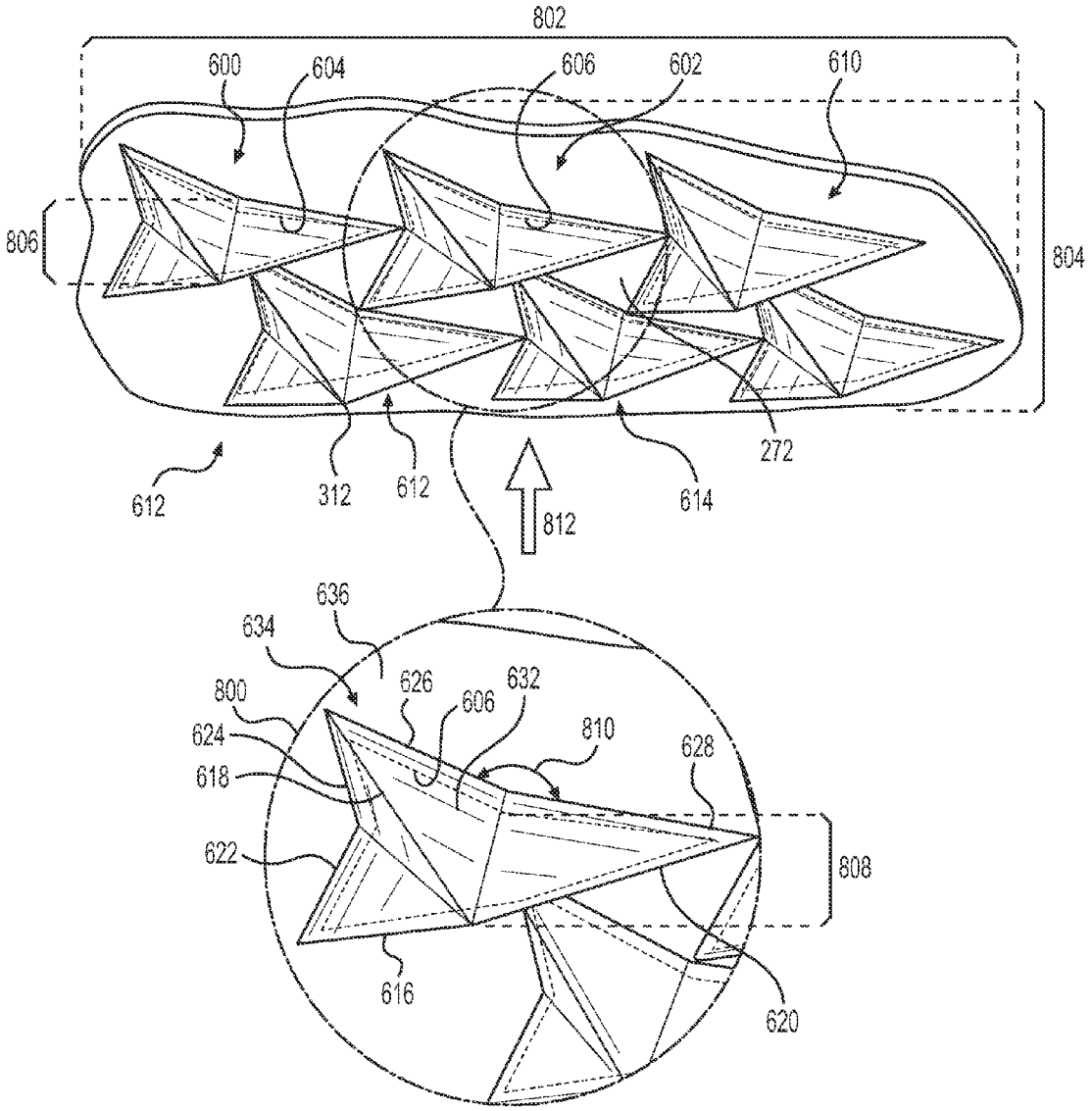
FIG. 8 is an isometric view of the outer surface of an embodiment of a portion of the outer member.

In FIGS. 6, 7, and 8, an embodiment of a portion of outer member 116 is shown. The portion of outer member 116 includes a first ground engaging member 600, a second ground engaging member 602, a third ground engaging member 610, a fourth ground engaging member 612, and a fifth ground engaging member 614. Dotted lines represent apertures corresponding to the ground engaging members, including, for example, a first aperture 604 corresponding to first ground engaging member 600, and a second aperture 606 corresponding to second ground engaging member 602.

In FIG. 6, first ground engaging member 600 has an apex 312 at a third height 642, and, as seen in magnified area 608, second ground engaging member 602 has an apex 312 at a fourth height 644. In some embodiments, the height of each apex 312 lies generally in the vertical plane of the outer member and extends from the bottom side of outer member toward the ground.

When a compressive force is applied, for example near the perimeter of the outer member, the heights of the ground engaging members may change. In FIG. 7, a third compressive force 710, is represented by an arrow. As a result of the application of third compressive force 710, the heights of first ground engaging member 600, second ground engaging member 602, third ground engaging member 610, fourth ground engaging member 612, and fifth ground engaging member 614 are decreased relative to the embodiment of FIG. 6. For example, first ground engaging member 600 has a fifth height 706, and, as seen in magnified area 700, second ground engaging member 602 has a sixth height 708. In the embodiments of FIGS. 6 and 7, fifth height 706 is less than third height 642, and sixth height 708 is less than fourth height 644.

If a different compressive force is applied, the heights of ground engaging members may further change. In FIG. 8, a fourth compressive force 812 is represented by an arrow. Fourth compressive force 812 is greater than third compressive force 710. As a result of the application of fourth compressive force 812, the heights of first ground engaging member 600, second ground engaging member 602, third ground engaging member 610, fourth ground engaging member 612, and fifth ground engaging member 614 are decreased relative to the embodiments of FIGS. 6 and 7. For example, first ground engaging member 600 has a seventh height 806, and, as seen in magnified area 800, second ground engaging member 602 has an eighth height 808. In the embodiments of FIGS. 6, 7, and 8, fifth height 706 is less than third height 642, seventh height 806 is less than fifth height 706, sixth height 708 is less than fourth height 644, and eighth height 808 is less than sixth height 708.

The change in height, as well as other changes to size and shape of ground engaging members, may be facilitated by hinge portions of each ground engaging member. For example, second ground engaging member 602 can be seen to include a first hinge portion 616, a second hinge portion 618, a third hinge portion 620, a fourth hinge portion 622, a fifth hinge portion 624, a sixth hinge portion 626, and a seventh hinge portion 628. Moreover, arm portions of second ground engaging member may be connected by hinge portions, for example, an eighth hinge portion 629. Additional hinge portions may be present along the side of second ground engaging member facing away from the viewer. As various forces are applied to second ground engaging member 602, each hinge portion may provide portions of second ground engaging member 602 with the ability to bend, rotate, or otherwise move, relative to other portions of second ground engaging member 602, or relative to other portions of outer member 116. In some embodiments, in order for apex 312 of second ground engaging member 602 to decrease in height, first hinge portion 616, second hinge portion 618, and/or third hinge portion 620 may each allow a splaying outward of the arm portions of second ground engaging member 602, in particular with respect to the two faces associated with each arm portion. For example, second ground engaging member 602 includes an arm portion 634, which has a first face 630 along one side, and a second face 632 along the generally opposing side. Second hinge portion 618 provides a connecting portion between first face 630 and second face 632 that is flexible and permits rotation of one face with respect to the adjoining face. In some embodiments, this feature provides one means for ground engaging members to splay outward.

Furthermore, in different embodiments, fourth hinge portion 622, fifth hinge portion 624, sixth hinge portion 626, seventh hinge portion 628, and other hinge portions disposed along the base of second ground engaging member 602 may allow a flattening or widening of the arm portions of second ground engaging member 602 with respect to their connection to outer member areas 272. For example, arm portion 634 of second ground engaging member 602 includes first face 630 that is adjoining an outer member area 636. Sixth hinge portion 626 provides a connecting portion between first face 630 and outer member area 636 that is flexible, and permits rotation of first face 630 with respect to outer member area 636. In some embodiments, this feature can allow ground engaging members to flatten in the vertical direction and/or expand in the horizontal direction.

Thus, in different embodiments, outer member 116 may experience different types of forces. During wear, foot and ground forces may compress the outer member along a generally vertical direction. In some embodiments, the outer member may be expanded or experience a force so that there is a splaying outward of the geometry of ground engaging member(s). This may occur during vertical compression, e.g., as a wearer exerts weight on article 100. For example, as depicted in FIGS. 7 and 8, third compressive force 710 and/or fourth compressive force 812 can alter the extent of "splay-out" or horizontal expansion of first ground engaging member 600 and second ground engaging member 602, particularly in the horizontal direction. In FIG. 6, two arm portions of second ground engaging member 602 form an obtuse angle 646. In FIG. 7, as a result of third compressive force 710, the two arm portions of second ground engaging member form an obtuse angle 712. In this case, angle 712 is greater than angle 646. Furthermore, in the embodiment of FIG. 8, the two arm portions of second ground engaging member 602 form an obtuse angle 810 after application of fourth compressive force 812. In this case, angle 810 is greater than angle 712. In other embodiments, forces may differ such that angle 712 may be greater than angle 646, and/or angle 810 is greater than angle 712. Furthermore, in some embodiments, the areas of first aperture 604 and second aperture 606 may increase when a compressive force is applied in the vertical direction.

Horizontal tensioning forces may also contribute to the expansion of ground engaging members. For example, when a ground engaging member experiences a horizontal tension due to friction with a ground surface, the ground engaging member may expand both in the direction of the tension, as well as in a direction perpendicular to the tension.

In some embodiments, the increased "splay-out" of first ground engaging member 600, second ground engaging member 602, third ground engaging member 610, fourth ground engaging member 612, and/or fifth ground engaging member 614 may alter the size, shape, and/or other characteristics of outer member 116. For example, in FIG. 6, the depicted portion of outer member has a third length 638, and a third width 640. When one or more ground engaging members are compressed, as by third compressive force 710 in FIG. 7, the depicted portion of outer member 116 has an increased fourth length 702, and an increased fourth width 704. In FIG. 8, the depicted portion of outer member 116 has a fifth length 802 that is greater than fourth length 702, and a fifth width 804 that is greater than fourth width 704. The flattening or splaying of different ground engaging members may thus change, expand, or increase the area of outer member 116 in some embodiments. In one embodiment, the length of outer member 116 may expand to the same extent as the width of outer member as a result of an applied force. In other embodiments, the length of outer member 116 may not increase as much as the width of outer member 116. For example, in some embodiments, fourth length 702 may expand or increase more relative to the expansion that occurs along fourth width 704 in response to the same force. In another embodiment, the width of outer member 116 may not increase as much as the length of outer member 116. For example, in some embodiments, fourth width 704 may expand or increase more relative to the expansion that occurs along fourth length 702 in response to the same force. Thus, the auxetic properties of the ground engaging members may allow various levels of expansion to outer member 116 that increase its size in the horizontal direction.

Depending on the magnitude and the direction of the force(s) applied, changes in area or shape may vary. It should be noted that forces applied in the lateral direction, as seen in FIGS. 4 and 5, may also result in similar changes in ground engaging member shapes, sizes, heights and/or area of outer member 116. For example, a tension may be applied to or along the sides of outer member 116, and may result in the splaying-out of ground engaging members. This can lead to a decrease in the height of the apex, which can create expansion in outer member 116. Thus, forces in the vertical, horizontal, or other directions may result in expansion in multiple directions.

In different embodiments, the overall geometry of ground engaging members 122 may also change. In some embodiments, a different force may permit ground engaging member(s) to increase in height. For example, in one embodiment, the outer member may be exposed to a force whereby fifth height 706 is greater than third height 642, seventh height 806 is greater than fifth height 706, sixth height 708 is greater than fourth height 644, and/or eighth height 808 is greater than sixth height 708.

Figure 9:
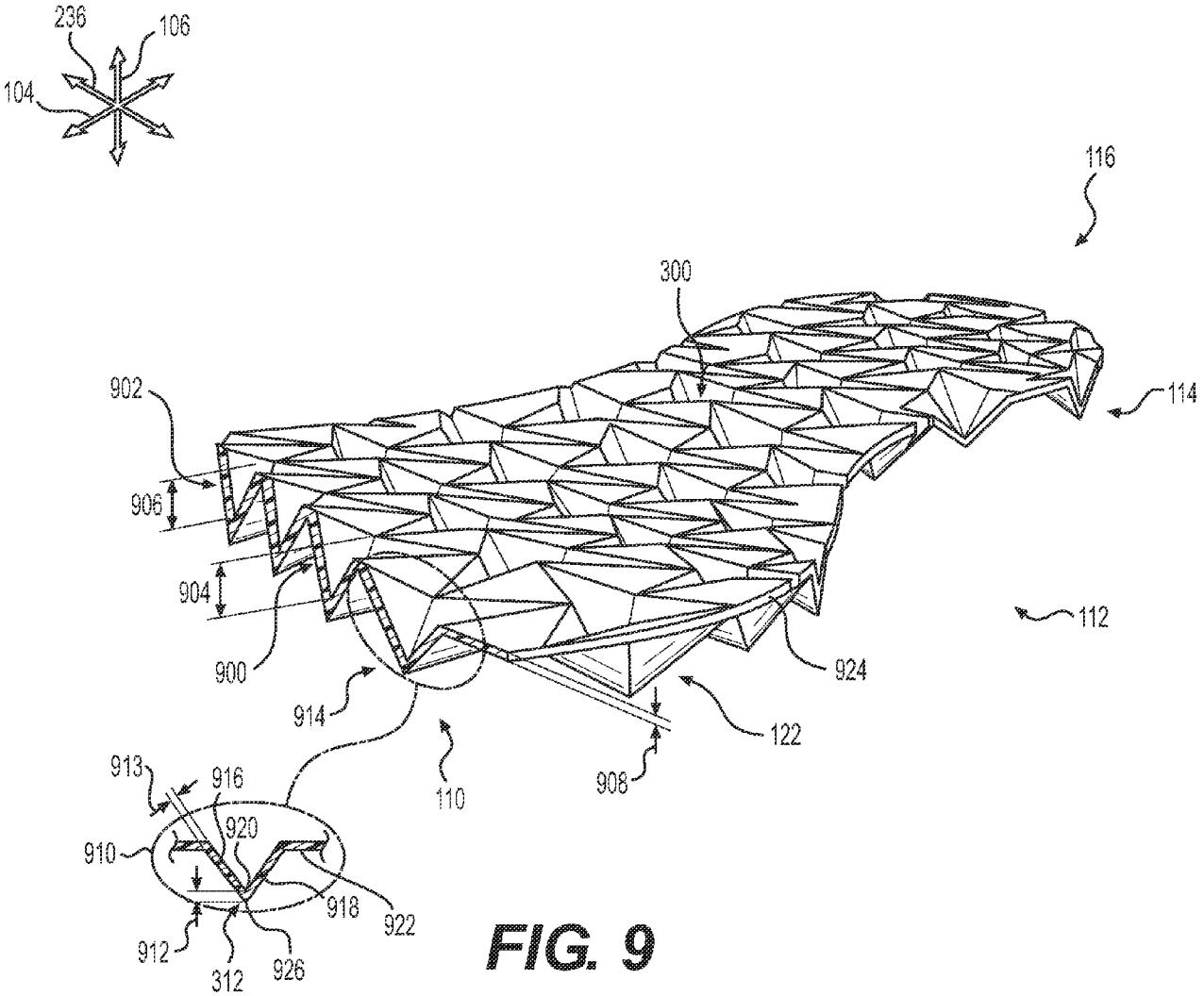
FIG. 9 is a schematic cross-section illustration of an embodiment of the ground engaging outer member shown in FIG. 3.

In different embodiments, the depths of apertures 300 may vary. FIG. 9 depicts a cross-section of the embodiment shown in FIG. 3, along the line labeled FIG. 9. In FIG. 9, it may be seen that the average depth of apertures 300 may be substantially uniform throughout outer member 116. For example, in FIG. 9, a first depth 904 of a first aperture 900 is substantially similar to a second depth 906 of a fourth aperture 902. In other embodiments, there may be differences in the average depth of each aperture. In one embodiment, apertures 300 may extend to a greater depth, where the height of a ground engaging member is greater than the height of neighboring ground engaging members 122. In other words, an apex of a ground engaging member may extend further from base portion 120 in vertical direction 106. This may permit greater traction and/or flexibility in some portions of ground engaging members 122.

Additionally, the thickness of outer member 116 may be substantially uniform throughout some or all portions of outer member 116. For example, in FIG. 9, a first thickness 908 of a base portion 924 is substantially similar to a second thickness 913 of base portion 924, where the first thickness 908 and the second thickness 913 are taken at different regions of base portion 924. In other embodiments, there may be minor differences in the average thickness of outer member 116 in different regions, allowing variations in the flexibility of outer member 116. In one embodiment, for example, outer member 116 may be thicker in forefoot region 110 than in heel region 114 or midfoot region 112. This may permit greater flexibility to the area of the foot associated with forefoot region 110. In the exemplary embodiment of FIG. 9, outer member areas 922 and/or base portion 924 may have a uniform thickness.

For example, in some embodiments, a third thickness 912 associated with apex 312 can be substantially similar to second thickness 913 associated with base portion 924. In FIG. 9, third thickness 912 of apex 312 is also depicted as substantially similar to first thickness 908 associated with base portion 924 of outer member 116. The uniformity in thickness can improve the auxetic action of outer member 116. In addition, the rigidity of the material comprising outer member 116 allows ground engaging members 122 to retain their overall shape and structure generally, while also deforming or expanding in response to external forces.

In addition, as seen in magnified area 910, ground engaging member 914 has an outer surface 918 and a corresponding inner surface 916. Inner surface 916 and/or outer surface 918 of ground engaging member 914 can include regions where outer member is bent or can curve sharply. For example, in some embodiments, inner surface 916 associated with apex 312 includes an inner apex 920, and outer surface 918 associated with apex 312 includes an outer apex 926. In particular, inner apex 920 and/or outer apex 926 may include sharply curved regions. In one embodiment, apex 312 can terminate in a generally sharp point.

As noted earlier, in different embodiments, due to the material included in outer member 116 and ground engaging members 122, portions of sole structure 102 may compress and deform to various degrees. For example, in some embodiments, as a result of the application of a deforming force, ground engaging members 122 may expand so that there is greater "splay out" of ground engaging members 122. In such a case, the apex of a ground engaging member may decrease in height, while the arm portions of the same ground engaging member may expand in width. In some embodiments, portions of outer member 116 may in turn also expand.

It should be noted that the various degrees of bending described and shown here are for purposes of illustration. In some situations outer member 116, ground engaging members 122, and/or sole structure 102 may not undergo compression to the extent depicted, or may bend less, depending on various factors such as the materials used in the production of outer member 116 and ground engaging members 122, the manner of attachment to upper 108, or other factors. For example, if outer member 116 is joined or attached to a less reactive material, the compressive and/or expansive properties described herein may differ, or be limited. In some embodiments, when outer member 116 is joined to a strobel or other structure, the capacity of expansion may decrease. In some embodiments, the perimeter of outer member 116 may be fixed, e.g., bonded to a strobel layer. However, in such embodiments the auxetic structure of outer member 116 may still facilitate increased flexibility for portions of outer member 116 even though the dimensions of the perimeter of outer member 116 may not change.

Figure 10:
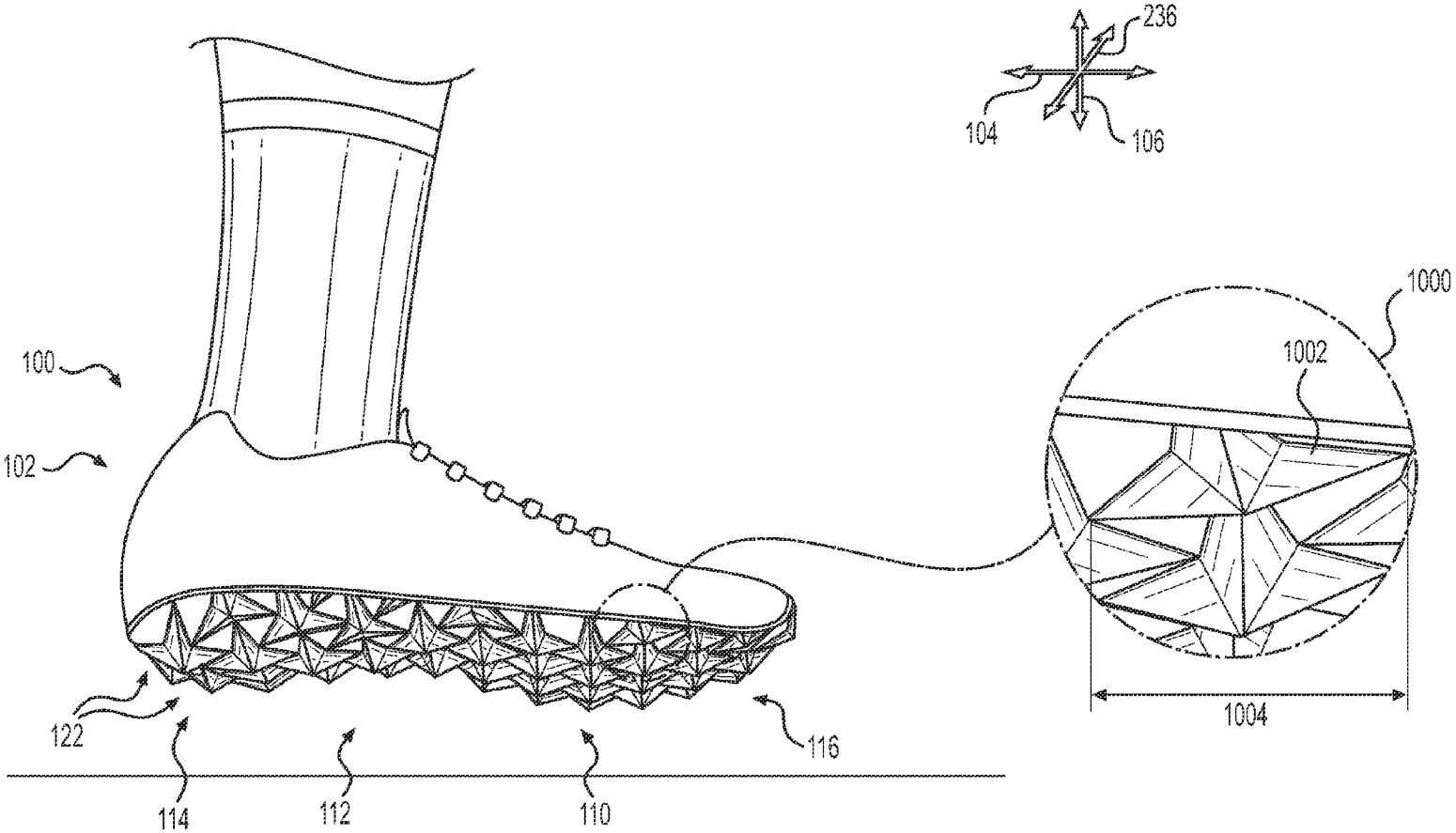
FIG. 10 is an isometric view of an embodiment of an article of footwear with ground engaging members.
Figure 11:
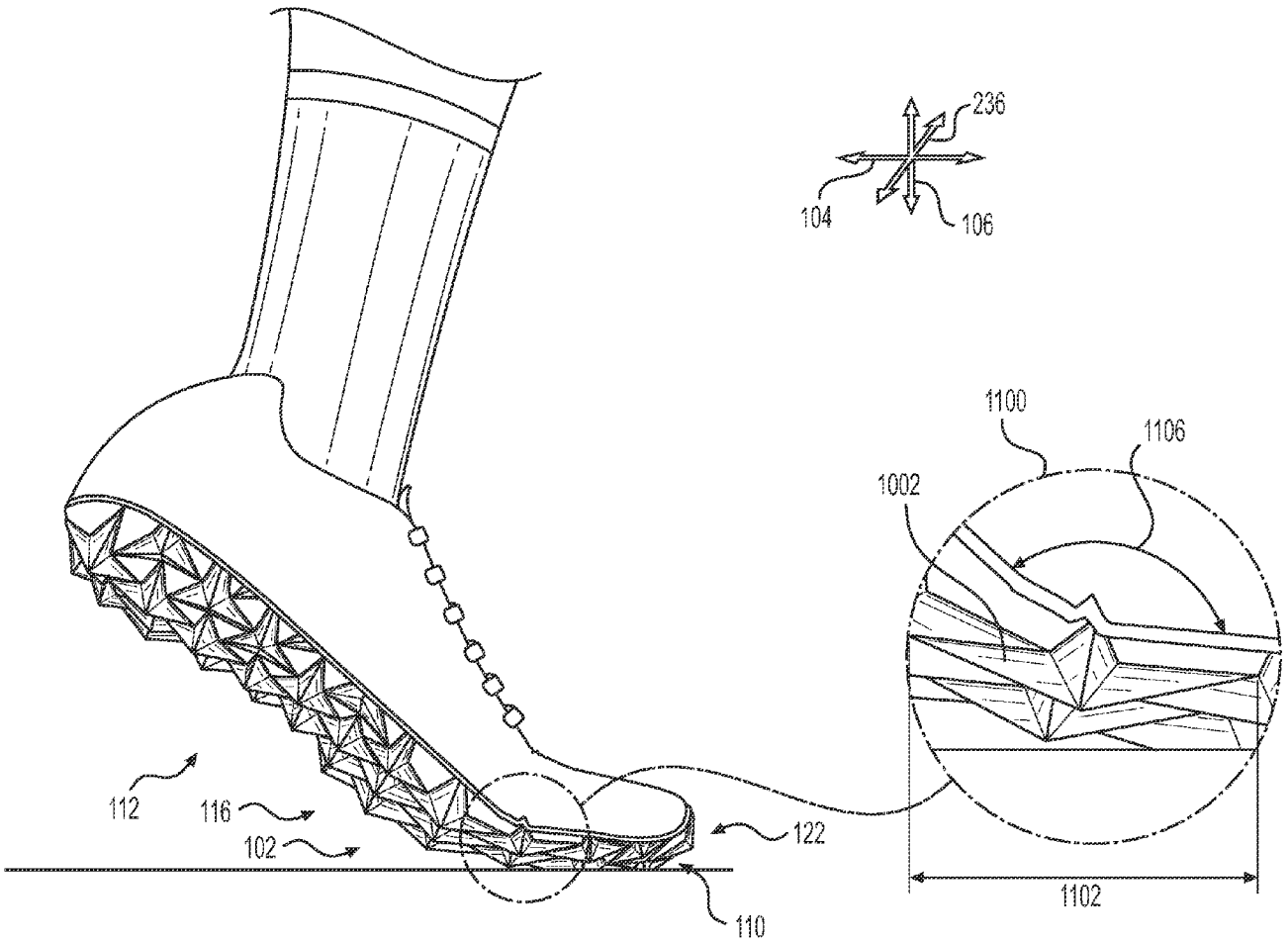
FIG. 11 is an isometric view of an embodiment of an article of footwear with ground engaging members.

Elasticity and flexibility of a sole component such as sole structure 102 is an important factor associated with comfort for article of footwear 100. In some embodiments, the stiffness of article of footwear 100 can be evaluated by twisting article of footwear 100 in one or more directions. FIGS. 10-11 depict an additional embodiment of article of footwear 100. In some embodiments, a force may be applied such that one or more regions are bent. The material(s) selected for sole structure 102 may permit variation in the degree of possible bending. In FIG. 10, article of footwear 100 is shown at rest. In FIG. 11, article of footwear 100 has been bent as a result of a force 1104. Sole structure 102 has been deformed upward along forefoot region 110 so that midfoot region 112 and heel region 114 are raised upwards. In other embodiments, the degree of bending may be greater or smaller, depending on the force applied and the materials comprising the structure of article of footwear 100. In one embodiment, outer member 116 may be designed such that there are preformed bending areas, lines, or axes, and outer member 116 may more readily bend along such lines.

Furthermore, in the embodiment of FIG. 10, a ground engaging member 1002 is shown in a magnified area 1000 of sole structure 102. Ground engaging member 1002 has a first width 1004. When midfoot region 112 and heel region 114 of outer member 116 are bent upwards, ground engaging member 1002 expands in order to permit bending. In FIG. 11, ground engaging member 1002 has become relatively flatter, and can be seen in magnified area 1100 as expanded to a larger width 1102. It should be noted that in other embodiments, article of footwear 100 may be bent along a different axis or plane.

In different embodiments, there may be outer member areas 272 that can move relative to ground engaging members 122 in order to allow expansion and/or compression. For example, in FIGS. 12 and 13, a first outer member area 1200, a second outer member area 1202, a third outer member area 1204, a fourth outer member area 1206, a fifth outer member area 1208, and a sixth outer member area 1210 are shown in the context of a sole structure 1254. Outer member areas 272 surrounding a first ground engaging member 1248 in FIGS. 12 and 13 have a substantially triangular shape.

Figures 12, 13:
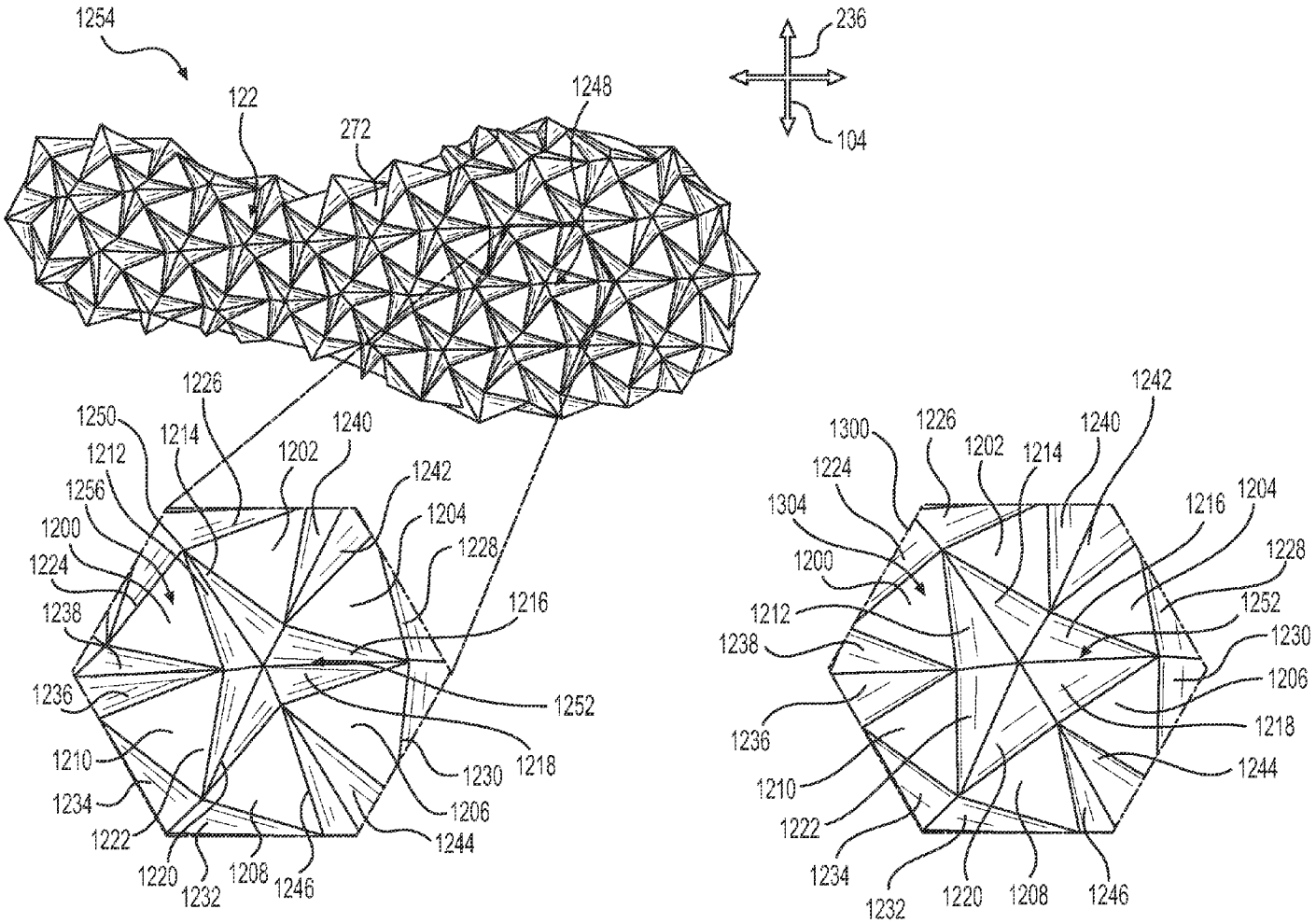
FIG. 12 is an illustration of the outer surface of an embodiment of an outer member for an article of footwear.
FIG. 13 is an illustration of a region of an embodiment of an outer member for an article of footwear.

Each outer member area depicted in a magnified area 1250 and a magnified area 1300 is defined or bounded in part by arm portions and/or faces of adjacent ground engaging members 122. In the embodiment of FIGS. 12 and 13, first outer member area 1200 is bounded by a first face 1212, a seventh face 1224, and a fourteenth face 1238. Second outer member area 1202 is bounded by a second face 1214, an eighth face 1226, and a fifteenth face 1240. Third outer member area 1204 is bounded by a third face 1216, a ninth face 1228, and a sixteenth face 1242. Fourth outer member area 1206 is bounded by a fourth face 1218, a tenth face 1230, and a seventeenth face 1244. Fifth outer member area 1208 is bounded by a fifth face 1220, an eleventh face 1232, and an eighteenth face 1246. Sixth outer member area 1210 is bounded by a sixth face 1222, a twelfth face 1234, and a thirteenth face 1236.

In different embodiments, as one or more ground engaging members 122 of sole structure 1254 expand from FIG. 12 to FIG. 13, outer member areas 272 may shift position and/or orientation. For example, in FIG. 12, first outer member area 1200 has a first position 1256 relative to adjacent second outer member area 1202. However, after expansion of first ground engaging member 1248 in FIG. 13, first outer member area 1200 has a second position 1304. In some embodiments, first position 1256 of first outer member area 1200 is different from second position 1304. In one embodiment, upon expansion of first ground engaging member 1248, first outer member area 1200 can rotate so that second position 1304 accommodates the expansion of ground engaging members 122. Similarly, in other embodiments, second outer member area 1202, third outer member area 1204, fourth outer member area 1206, fifth outer member area 1208, sixth outer member area 1210, and other outer member areas 272 may also change position relative to adjacent outer member areas upon the expansion of one or more portions of sole structure 1254. In at least some embodiments, these outer member areas may be seen to rotate with respect to one another, to allow for increases in the horizontal area of the ground engaging members.

Figure 14:
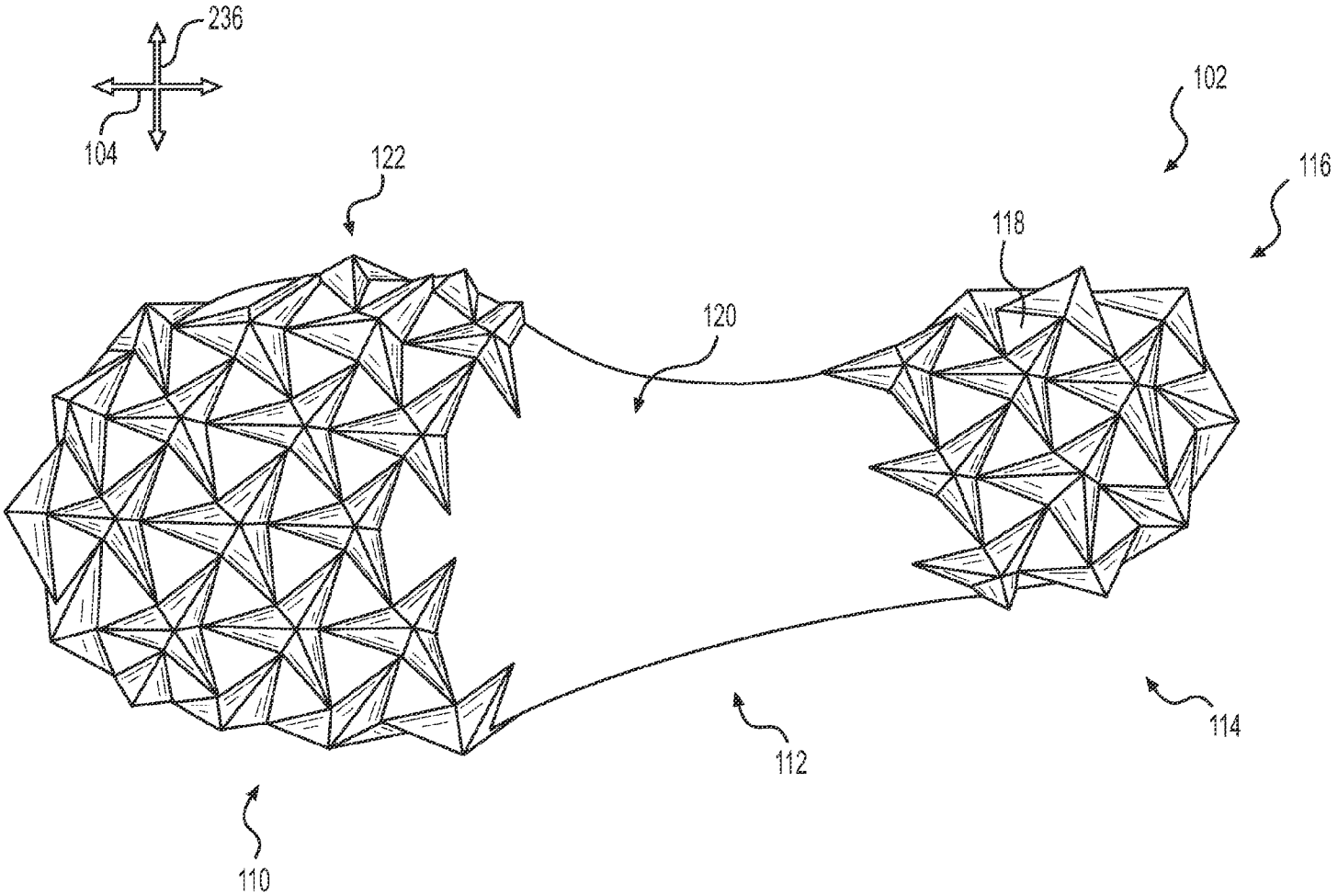
FIG. 14 is a schematic illustration of the outer surface of an embodiment of a ground engaging outer member with ground engaging members for an article of footwear.
Figure 15:
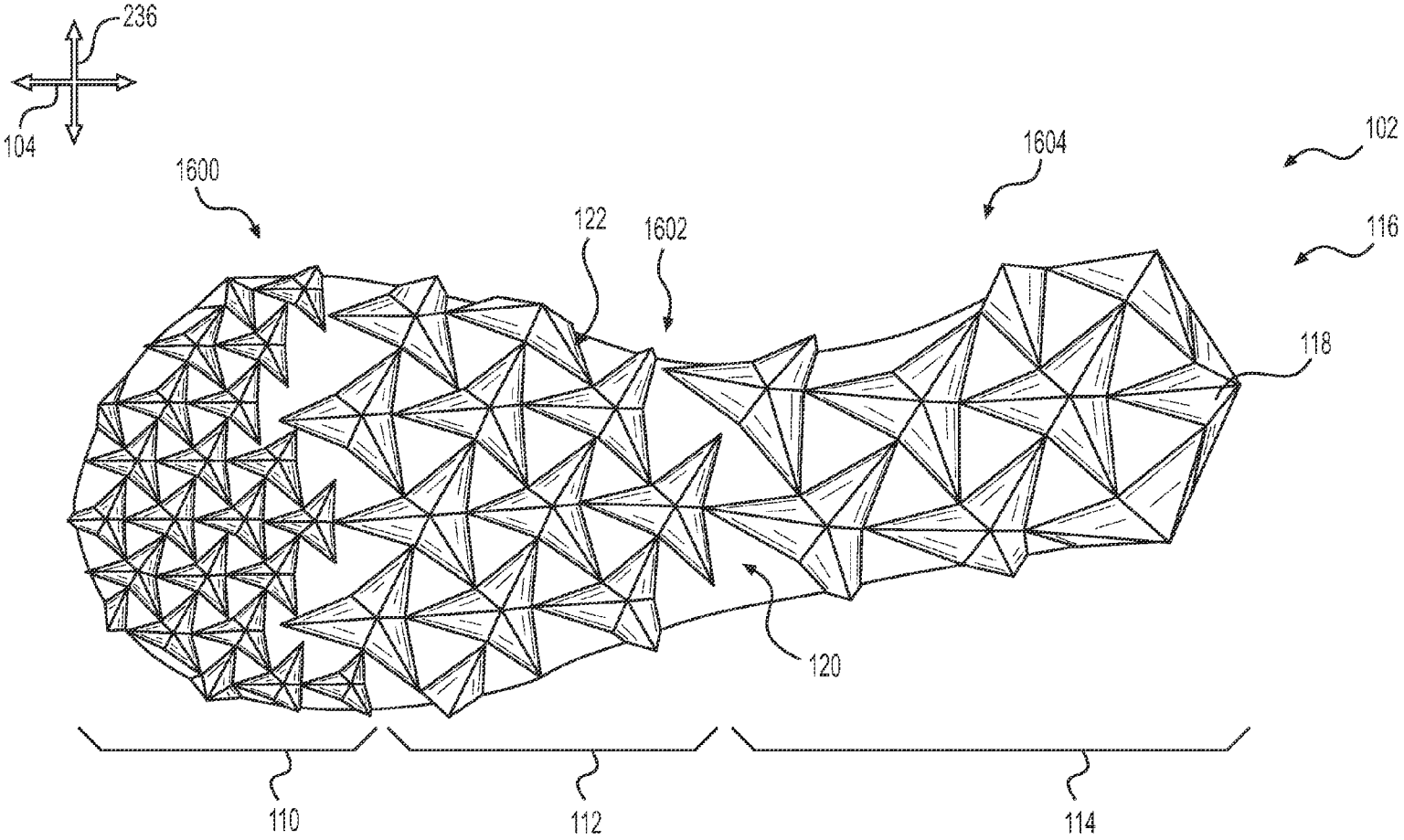
FIG. 15 is a schematic illustration of the outer surface of an embodiment of a ground engaging outer member with ground engaging members for an article of footwear.

As shown in the embodiments above, ground engaging members 122 may be disposed all along outer member 116, so that substantially the entire base portion 120 of outer member 116 from forefoot region 110 to heel region 114 includes ground engaging members 122. In other embodiments, ground engaging members 122 may be utilized at any suitable location of outer member 116. FIGS. 14-15 depict different embodiments of article of footwear 100 with ground engaging members 122. In some embodiments, ground engaging members 122 having particular shapes and configurations may be disposed at regions of outer member 116 corresponding with various anatomical portions of the foot. Furthermore, in some embodiments, article 100 may include greater or fewer ground engaging members 122 as desired to provide performance characteristics suitable for the desired use.

For example, as illustrated in FIG. 14, one or more ground engaging members 122 may be disposed in areas that correspond with forefoot region 110 and heel region 114. An athlete may place a significant amount of their weight on these regions during certain movements, such as cutting in a lateral direction 236, or during abrupt stopping. Such an embodiment may provide an athlete with greater flexibility along midfoot region 112. In other embodiments, forefoot region 110 may have a reduced number of ground engaging members 122, in order to provide sole structure with even greater flexibility along forefoot region 110. Such portions may include at least one ground engaging member 122 in order to provide traction in lateral direction 236. However, an article of footwear that includes ground engaging members 122 in forefoot region 110, heel region 114, and/or other regions, as depicted in FIG. 14, may nevertheless continue to provide a high level of flexibility in those regions, due to the construction of outer member 116 described herein.

The configuration of sole structure 102 may vary significantly according to one or more types of ground surfaces on which sole structure 102 may be used in different embodiments. Accordingly, outer member 116 may be configured to provide traction on various surfaces, such as natural turf (e.g., grass), synthetic turf, dirt, snow. In some embodiments, sole structure 102 may also vary based on the properties and conditions of the surfaces on which article 100 is anticipated to be used. For example, sole structure 102 may vary depending on whether the surface is harder or softer. In addition, sole structure 102 may be tailored for use in wet or dry conditions. In other embodiments, the configuration of sole structure 102, including the traction pattern of outer member 116, may vary significantly according to the type of activity for which article 100 is anticipated to be used (for example, running, soccer, baseball, football, and other activities), as described further below.

In some embodiments, sole structure 102 may be configured for versatility. For example, sole structure 102 may be configured to provide traction and stability on a variety of surfaces, having a range of properties, and/or under various conditions. In another embodiment, a versatile embodiment of sole structure 102 may include both larger and medium sized ground engaging members 122, and/or ground engaging members 122 having moderately to minimally aggressive shapes, a different number of hinge portions, and being disposed in different regions of outer member 116. In FIG. 15, for example, a series of large three-pointed diamond shaped ground engaging members 1604 are disposed in heel region 114 and a series of medium three-pointed diamond shaped ground engaging members 1602 are disposed in midfoot region 112. Furthermore, a number of small three-pointed star shaped ground engaging members 1600 are disposed in forefoot region 110. While the number, size, and shape of ground engaging members 122 are provided as examples, other structural parameters may be varied in order to tailor article 100 for traction and stability on various surfaces, and/or in a variety of conditions. Additional such parameters may include, for example, the use of secondary traction elements, placement of ground engaging members 122, the relative softness or hardness of the ground engaging members 122 and/or sole structure 102 in general, the relative flexibility of portions of sole structure 102, and other such parameters.

Embodiments can include provisions to further control the movement of ground engaging members. In some embodiments, one or more hinge portions of a ground engaging member could be modified to achieve increased and/or decreased flexibility along the hinge portion. Moreover, provisions can include modifying the thickness of the outer member along the hinge portion, for example by adding a notch, groove, cut-out or other provision that reduces the thickness along the hinge portion.

Figure 16:
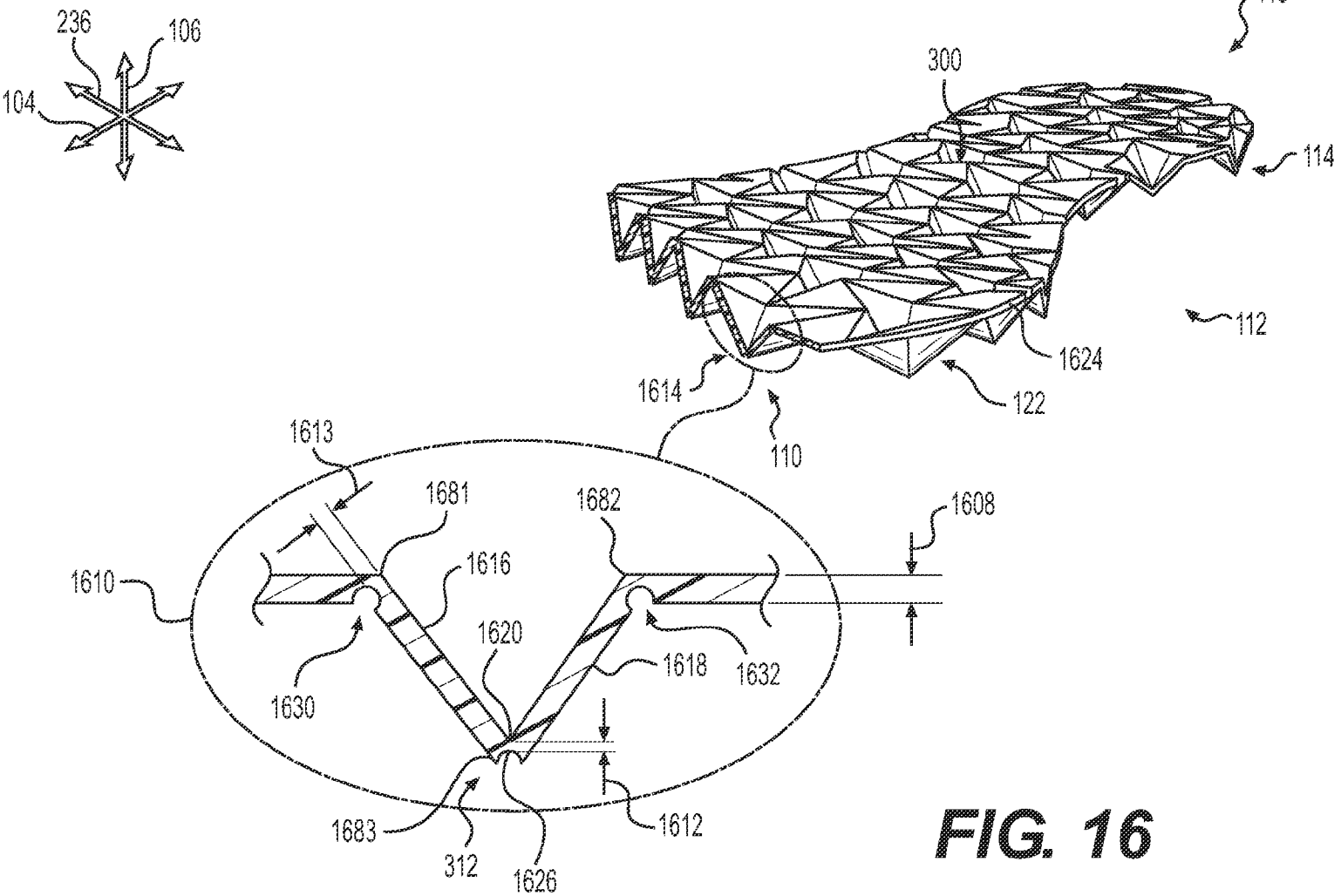
FIG. 16 is a schematic cross-section illustration of an embodiment of the ground engaging outer member.

FIG. 16 depicts a cross-section of another embodiment of a sole structure. In FIG. 16, as seen in a magnified area 1610, a ground engaging member 1614 has an outer surface 1618 and a corresponding inner surface 1616. As seen in the enlarged cross-sectional view of FIG. 16, ground engaging member 1614 may include a first hinge portion 1681 and a second hinge portion 1682. First hinge portion 1681 and second hinge portion 1682 are associated with the intersection of ground engaging member 1614 with adjacent portions of the outer member 116. Furthermore, apex 312, which includes an inner apex portion 1620 and an outer apex portion 1626, may be associated with a third notch 1683, which is formed as the intersection of other hinge portions of ground engaging member 1614.

Each hinge portion shown in FIG. 16 further includes a notch. For purposes of illustration, the notches are shown in cross-section. However it may be appreciated that the notches may extend along the length of each hinge portion. Alternatively, some notches may only extend partially along the length of a hinge portion. As seen in FIG. 16, first hinge portion 1681 includes first notch 1630 and second hinge portion 1682 includes second notch 1632. As indicated in FIG. 16, first hinge portion 1630 has a thickness 1613. Moreover, the presence of first notch 1630 results in a decreased thickness for first hinge portion 1630 as compared to thickness 1608, which is the thickness of portions of ground engaging member 1614 proximate to first hinge portion 1630. Thickness 1608 may also be substantially similar to the thickness of one or more regions along a base portion 1624 in some embodiments. Similarly, the thickness of second hinge portion 1632 may be substantially less than thickness 1608 of portions of outer member 1614 adjacent to second hinge portion 1632.

The thickness of ground engaging member 1614 at apex 312 may also be reduced. In the embodiment of FIG. 16, apex 312 has a thickness 1612 due to the presence of third notch 1683. As seen, thickness 1612 is substantially less than thickness 1608.

In the embodiment of FIG. 16, the thickness of a ground engaging member along hinge portions is reduced by introducing notches along outer surface 1618 of ground engaging member 1614. Specifically, first notch 1630, second notch 1632 and third notch 1683 are all disposed on outer surface 1618. Alternatively, the notches could be disposed on an inner surface of a ground engaging member, as shown in another embodiment in FIG. 17.

Figure 17:
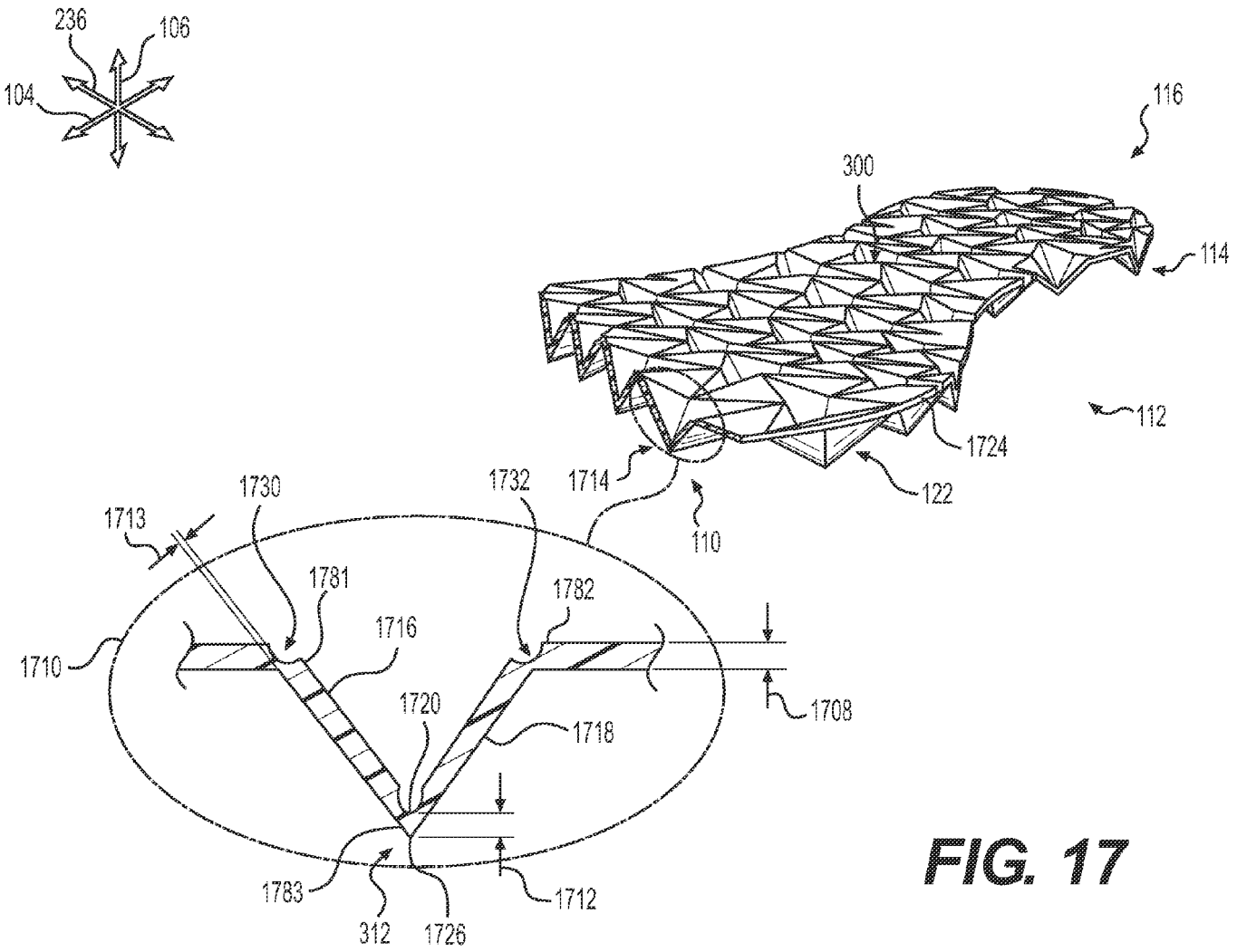
FIG. 17 is a schematic cross-section illustration of an embodiment of the ground engaging outer member.

FIG. 17 depicts a cross-section of another embodiment of a sole structure. In FIG. 17, as seen in a magnified area 1710, a ground engaging member 1714 has an outer surface 1718 and a corresponding inner surface 1716. As seen in the enlarged cross-sectional view of FIG. 17, ground engaging member 1714 may include a first hinge portion 1781 and a second hinge portion 1782. First hinge portion 1781 and second hinge portion 1782 are associated with the intersection of ground engaging member 1714 with adjacent portions of the outer member 116. Furthermore, apex 312, which includes an inner apex portion 1720 and an outer apex portion 1726, may be associated with a third notch 1783, which is formed as the intersection of other hinge portions of ground engaging member 1714.

In contrast to the notches disposed on an outer surface of a ground engaging member as shown in FIG. 16, the embodiment of FIG. 17 includes first notch 1781, second notch 1782 and third notch 1783 all on inner surface 1716 of ground engaging member 1714. Alternatively, some notches could be disposed on an inner surface, while other notches could be disposed on an outer surface. The choice of placing notches on an inner surface or an outer surface could be made according to factors including manufacturing considerations as well as possibly other considerations. For example, notches on an outer surface may collect dirt and may therefore be less desirable for articles configured to be used on dirt, where notches on an inner surface may be more desirable. Notches on an outer surface, however, may be used on surfaces where dirt is not generally present, such as hardwood floors, artificial turf, outdoor tracks, etc.

Each hinge portion shown in FIG. 17 further includes a notch. For purposes of illustration, the notches are shown in cross-section. However it may be appreciated that the notches may extend along the length of each hinge portion. Alternatively, some notches may only extend partially along the length of a hinge portion. As seen in FIG. 17, first hinge portion 1781 includes first notch 1730 and second hinge portion 1782 includes second notch 1732. As indicated in FIG. 17, first hinge portion 1730 has a thickness 1713. Moreover, the presence of first notch 1730 results in a decreased thickness for first hinge portion 1730 as compared to thickness 1708, which is the thickness of portions of ground engaging member 1714 proximate to first hinge portion 1730. Thickness 1708 may also be substantially similar to the thickness of one or more regions along a base portion 1724 in some embodiments. Similarly, the thickness of second hinge portion 1732 may be substantially less than thickness 1708 of portions of outer member 1714 adjacent to second hinge portion 1732.

The thickness of ground engaging member 1714 at apex 312 may also be reduced. In the embodiment of FIG. 17, apex 312 has a thickness 1712 due to the presence of third notch 1783. As seen, thickness 1712 is substantially less than thickness 1708.

In the embodiment of FIG. 17, the thickness of a ground engaging member along hinge portions is reduced by introducing notches along outer surface 1718 of ground engaging member 1714. Specifically, first notch 1730, second notch 1732 and third notch 1783 are all disposed on outer surface 1718. Alternatively, the notches could be disposed on an inner surface of a ground engaging member, as shown in another embodiment in FIG. 16.

By reducing the thickness of the hinge portions (and/or at the apex) of a ground engaging member, as occurs in the embodiments of FIGS. 16 and 17, adjacent portions of an outer member flex more easily along the hinge portions than would otherwise occur if the outer member thickness were constant throughout the whole ground engaging member. Moreover, the exemplary arrangement may provide living hinges between adjacent portions of an outer member. This allows the geometry of the ground engaging members to change more easily, thereby improving auxetic motion of the outer member, and enhancing overall flexibility of the sole.

The embodiments of FIGS. 16-17 depict a particular rounded geometry for notches in hinge portions. Other embodiments, however, could notches, grooves or other cut-out portions with any contoured shapes, including linear and non-linear shapes.

In some cases, it may be advantageous to provide increased torsional traction on one foot, and to provide decreased torsional traction on the other foot to enable greater freedom of motion. That is, it may be desirable to provide one or more portions of the rear foot with a reduced amount of torsional traction and provide one or more portions of the front foot with an increased amount of torsional traction. Accordingly, in some embodiments, asymmetric outer members may be provided for left and right feet. That is, outer member 116 for a left foot may be a non-mirror image of the outer member 116 for a right foot.

While various embodiments of the embodiment have been described, the description is intended to be exemplary, rather than limiting and it will be apparent to those of ordinary skill in the art that many more embodiments and implementations are possible that are within the scope of the embodiment. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the embodiment is not to be restricted except in light of the attached claims and their equivalents. Also, various modifications and changes may be made within the scope of the attached claims.

What is claimed is:

1. A sole structure for an article of footwear, the sole structure comprising:

an outer member having an inner surface and an outer surface;

a plurality of ground engaging members extending from the outer surface away from a base portion of the outer member, the plurality of ground engaging members including a first ground engaging member;

a plurality of apertures extending into the outer member from the inner surface, wherein each of the plurality of apertures extends into a respective one of the plurality of ground engaging members, and wherein the plurality of apertures includes a first aperture corresponding to the first ground engaging member;

the plurality of ground engaging members being configured to directly contact a ground surface;

the first ground engaging member comprising at least a first arm portion, the first arm portion comprising a first face and a second face, the first face and the second face joined along a first hinge portion, the first face attached to the outer member along a second hinge portion, the second face attached to the outer member along a third hinge portion;

the first face and the second face each comprising substantially flat outer surfaces;

a free end of the first ground engaging member being a central tip comprising an apex, wherein an end of the first face is associated with the apex, and wherein an end of the second face is associated with the apex;

the first face and the second face each extending from the base portion to the apex;

the apex terminating in a substantially sharp point;

the first ground engaging member and first aperture cooperating to define a first configuration and a second configuration, wherein the apex has a first height with respect to the base portion in the first configuration, and has a second height with respect to the base portion in the second configuration, and wherein the aperture has a first aperture area at the inner surface in the first configuration and a second aperture area at the inner surface in the second configuration;

wherein the first hinge portion, the second hinge portion, and the third hinge portion facilitate the transition of the first ground engaging member between the first configuration and the second configuration; and wherein the sole structure at least partially comprises an auxetic structure, and wherein the plurality of ground engaging members and apertures are arranged on the outer member to provide the sole structure with the auxetic structure.

2. The sole structure of claim 1, wherein the first ground engaging member includes polygonal features.

3. The sole structure of claim 1, wherein the plurality of ground engaging members further include a second ground engaging member, and wherein the second ground engaging member has a shape that is substantially different from the shape of the first ground engaging member.

4. The sole structure of claim 1, wherein the first ground engaging member has a geometry approximately corresponding to a pyramid with a tri-star base.

5. The sole structure of claim 1, wherein one or more ground engaging members are disposed substantially near a perimeter of the outer member, and wherein at least one of the ground engaging members disposed near the perimeter of the outer member includes a second arm portion, wherein the second arm portion has a second length, wherein the first arm portion of the first ground engaging member has a first length, and wherein the first length is greater than the second length.

6. The sole structure of claim 1, wherein the outer member has a longitudinal length; and wherein at least a portion of the plurality of ground engaging members are disposed adjacent to one another along a first direction such that substantially all portions of the longitudinal length of the base portion of the outer member are occupied by at least one ground engaging member.

7. The sole structure of claim 6, wherein the outer member further includes a lateral length; and wherein at least a portion of the plurality of ground engaging members are disposed adjacent to one another along a second direction such that substantially all portions of the lateral length of the base portion of the outer member are occupied by at least one ground engaging member.

8. A sole structure for an article of footwear, the sole structure comprising:

an outer member;

the outer member being an outermost bottom layer of the sole structure;

a plurality of ground engaging members extending away from a base portion of the outer member, each of the ground engaging members including a plurality of hinge portions, the plurality of ground engaging members comprising at least a first ground engaging member, the first ground engaging member having a three-pointed star shape in a horizontal plane;

the first ground engaging member comprising a first arm portion, a second arm portion, and a third arm portion, the first arm portion including a first face and a second face, wherein the first face and the second face are joined along a first hinge portion, the first hinge portion being configured to permit rotation of the first face with respect to the second face, the second arm portion including third face and a fourth face, wherein the third face and the fourth face are joined along a second hinge portion, the second hinge portion being configured to permit rotation of the third face with respect to the fourth face, the third arm portion including a fifth face and a sixth face, wherein the fifth face and the sixth face are joined along a third hinge portion, the third hinge portion being configured to permit rotation of the fifth face with respect to the sixth face;

the first face being attached to the outer member along a fourth hinge portion, the second face being attached to the outer member along a fifth hinge portion, the third face being attached to the outer member along a sixth hinge portion, the fourth face being attached to the outer member along a seventh hinge portion, the fifth face being attached to the outer member along an eighth hinge portion, the sixth face being attached to the outer member along a ninth hinge portion;

the first arm portion and the second arm portion being joined along a tenth hinge portion, the second arm portion and the third arm portion being joined along an eleventh hinge portion, the third arm portion and the first arm portion being joined along a twelfth hinge portion;

a free end of the first ground engaging member being an apex, the apex defined at the intersection of the first hinge portion, the second hinge portion, and the third hinge portion;

a plurality of apertures extending from an inner surface of the outer member, wherein each of the plurality of apertures extends into a respective one of the plurality of ground engaging members, and wherein the plurality of apertures includes a first aperture corresponding to the first ground engaging member, the first aperture defined between the first face, the second face, the third face, the fourth face, the fifth face, and the sixth face; and wherein the sole structure at least partially comprises an auxetic structure, and wherein the plurality of ground engaging members, the plurality of apertures, and the plurality of hinge portions are arranged on the outer member to provide the sole structure with the auxetic structure.

9. The sole structure of claim 8, wherein at least two of the plurality of ground engaging members are generally disposed along a first direction, at least two of the plurality of ground engaging members are generally disposed along a second direction, and at least two of the plurality of ground engaging members are generally disposed along a third direction, such that substantially all portions of the base portion of the outer member are occupied by at least one ground engaging member.

10. The sole structure of claim 8, wherein the first ground engaging member includes a central region, and the first arm portion, the second arm portion, and the third arm portion extend radially from the central region, wherein the first arm portion and the second arm portion are adjacent and form a first obtuse angle, the second arm portion and the third arm portion are adjacent and form a second obtuse angle, and the third arm portion and the first arm portion are adjacent and form a third obtuse angle.

11. The sole structure of claim 10, wherein the magnitudes of the first obtuse angle, the second obtuse angle, and the third obtuse angle are substantially equivalent.

12. The sole structure of claim 10, wherein the magnitudes of the first obtuse angle, the second obtuse angle, and the third obtuse angle change in response to a force.

13. The sole structure of claim 10, further including a second ground engaging member substantially similar to the first ground engaging member, wherein the second ground engaging member includes a first arm portion, wherein the first arm portion of the second ground engaging member ends in a vertex, wherein the vertex is disposed in an area defined by the third obtuse angle of the first ground engaging member, and wherein the vertex is substantially adjacent to the central region of the first ground engaging member.

14. The sole structure of claim 8, wherein the first aperture has an aperture area in a substantially horizontal plane, and the aperture area changes in response to a compressive force.

* * * * *